US010449426B2

(12) United States Patent
Franklin et al.

(10) Patent No.: US 10,449,426 B2
(45) Date of Patent: Oct. 22, 2019

(54) GOLF CLUBS AND GOLF CLUB HEADS WITH REMOVABLE DAMPENING MEMBER IN SOLE

(71) Applicant: Karsten Manufacturing Corporation, Phoenix, AZ (US)

(72) Inventors: David N. Franklin, Granbury, TX (US); Michael Wallans, Portland, OR (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/107,961

(22) Filed: Aug. 21, 2018

(65) Prior Publication Data

US 2018/0369658 A1 Dec. 27, 2018

Related U.S. Application Data

(63) Continuation of application No. 14/726,260, filed on May 29, 2015, now Pat. No. 10,130,849.

(51) Int. Cl.

| | |
|---|---|
| ***A63B 53/06*** | (2015.01) |
| ***A63B 53/04*** | (2015.01) |
| ***A63B 60/54*** | (2015.01) |

(52) U.S. Cl.

CPC ..... *A63B 53/0466* (2013.01); *A63B 53/06* (2013.01); *A63B 60/54* (2015.10); *A63B 2053/045* (2013.01); *A63B 2053/0491* (2013.01)

(58) Field of Classification Search

CPC ..... A63B 53/06; A63B 53/0466; A63B 60/54; A63B 2053/045; A63B 2053/0491

See application file for complete search history.

(56) References Cited

U.S. PATENT DOCUMENTS

| | | | | |
|---|---|---|---|---|
| 2,171,383 A * | 8/1939 | Wettlaufer | ..... | A63B 53/08 473/335 |
| 5,890,973 A * | 4/1999 | Gamble | ..... | A63B 21/0602 473/326 |
| 6,514,153 B2 * | 2/2003 | Miyamoto | ..... | A63B 60/00 473/305 |
| 6,524,197 B2 * | 2/2003 | Boone | ..... | A63B 53/0466 473/324 |
| 6,558,271 B1 * | 5/2003 | Beach | ..... | A63B 53/04 473/327 |

(Continued)

FOREIGN PATENT DOCUMENTS

| | | |
|---|---|---|
| JP | H07031698 | 2/1995 |
| JP | H10127836 | 5/1998 |

(Continued)

*Primary Examiner* — William M Pierce

(57) ABSTRACT

Ball striking devices, such as golf clubs, have a head that includes a face having a striking surface configured for striking a ball, and a body connected to the face and extending rearwardly from the face, with the body having a crown, a sole, a heel side, and a toe side, such that the face and the body combine to define an enclosed internal cavity. A damping member is connected to the body and includes a post extending inwardly into the cavity from an inner surface of the body, a first arm extending from the post toward the heel side of the body, and a second arm extending from the post toward the toe side of the body. The damping member is configured to produce a mass damping effect upon an impact on the face.

20 Claims, 14 Drawing Sheets

(56) References Cited

U.S. PATENT DOCUMENTS 6,964,617 B2 11/2005 Williams
7,074,132 B1 * 7/2006 Finn ..... A63B 53/0487 473/255
7,108,609 B2 * 9/2006 Stites ..... A63B 53/06 473/256
7,798,914 B2 * 9/2010 Noble ..... A63B 53/0466 473/324
7,854,667 B2 * 12/2010 Gillig ..... A63B 53/0466 473/334
8,133,128 B2 3/2012 Boyd et al.
8,210,961 B2 * 7/2012 Finn ..... A63B 53/0466 473/244
8,272,976 B2 * 9/2012 DAgostino ..... A63B 47/002 294/19.2
8,475,292 B2 * 7/2013 Rahrig ..... A63B 53/0466 473/324
8,956,244 B1 * 2/2015 Westrum ..... A63B 53/04 473/338
2002/0169036 A1 11/2002 Boone
2006/0154747 A1 * 7/2006 Beach ..... A63B 53/0466 473/345
2009/0298613 A1 * 12/2009 Hirsch ..... A63B 53/0466 473/346
2010/0029409 A1 * 2/2010 Noble ..... A63B 53/04 473/346
2011/0081987 A1 * 4/2011 Gillig ..... A63B 53/0466 473/334
2011/0224017 A1 * 9/2011 Thomas ..... A63B 53/0466 473/332
2011/0275446 A1 * 11/2011 Rahrig ..... A63B 53/0466 473/246
2014/0187346 A1 * 7/2014 Beno ..... A63B 60/00 473/332
2014/0256463 A1 * 9/2014 Knight ..... A63B 53/0466 473/332
2015/0297959 A1 * 10/2015 Lee ..... A63B 53/0466 473/332

FOREIGN PATENT DOCUMENTS

JP H11114112 4/1999
JP 2004351096 12/2004

* cited by examiner

GOLF CLUBS AND GOLF CLUB HEADS WITH REMOVABLE DAMPENING MEMBER IN SOLE

TECHNICAL FIELD

This is a continuation of U.S. patent application Ser. No. 14/726,260 filed May 29, 2015, which is incorporated by reference in its entirety.

The invention relates generally to ball striking devices, such as golf clubs and golf club heads, utilizing mass damping effects at impact. Certain aspects of this invention relate to golf club heads having a damping member configured to create a mass damping effect upon an impact on the face.

BACKGROUND

Golf clubs and many other ball striking devices can encounter undesirable effects when the ball being struck impacts the ball striking head away from the optimum location, which may be referred to as an "off-center impact." In a golf club head, this optimum location is, in many cases, aligned laterally and/or vertically with the center of gravity (CG) of the head. Even slightly off-center impacts can sometimes significantly affect the performance of the head, and can result in reduced velocity and/or energy transfer to the ball, inconsistent ball flight direction and/or spin caused by twisting of the head, increased vibration that can produce undesirable sound and/or feel, and other undesirable effects. Technologies that can reduce or eliminate some or all of these undesirable effects could have great usefulness in golf club heads and other ball striking devices.

The present devices and methods are provided to address at least some of the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the disclosure relate to ball striking devices, such as golf clubs, with a head that includes a face having a striking surface configured for striking a ball, the face having a heel portion and a toe portion, and a body connected to the face and extending rearwardly from the face, with the body having a crown, a sole, a heel side, and a toe side, such that the face and the body combine to define an enclosed internal cavity. A damping member is connected to the body and includes a post extending inwardly into the cavity from an inner surface of the body, a first arm extending from the post toward the heel side of the body, and a second arm extending from the post toward the toe side of the body. The damping member is configured to produce a mass damping effect upon an impact on the face.

According to one aspect, the post acts as a torsion bar, the post is configured to exert at least a counterclockwise torsional force on the face during the impact on the toe portion of the face and to exert at least a clockwise torsional force on the face during the impact on the heel portion of the face, when viewed from above, to create the mass damping effect.

According to another aspect, the first arm further includes a first weight member connected to the first arm and the second arm further includes a second weight member connected to the second arm, wherein the first and second weight members have greater densities than the post.

According to a further aspect, the head also includes a first abutment member connected to the inner surface of the body and positioned within the cavity adjacent the first arm, with the first abutment member having a resilient material engaging a front surface of the first arm, and a second abutment member connected to the inner surface of the body and positioned within the cavity adjacent the second arm, with the second abutment member having a resilient material engaging a front surface of the second arm. The resilient material of the first abutment member is configured to be compressed by the first arm during the impact on the heel portion of the face, and the resilient material of the second abutment member is configured to be compressed by the second arm during the impact on the toe portion of the face, creating the mass damping effect. In one configuration, the first abutment member further has the resilient material engaging a rear surface of the first arm, and the second abutment member further has the resilient material engaging a rear surface of the second arm. In this configuration, the resilient material of the first abutment member is configured to be compressed by the first arm during the impact on the toe portion of the face, and the resilient material of the second abutment member is configured to be compressed by the second arm during the impact on the heel portion of the face, to further provide the mass damping effect.

According to yet another aspect, the post has a fixed end that is fixed to the body and a free end positioned within the rear cavity. In one configuration, the head further includes an abutment member connected to the inner surface of the body opposite the fixed end of the post and positioned within the cavity, with the abutment member having a resilient material engaging the free end of the post. The resilient material of the first abutment member is configured to be compressed by the free end of the post during the impact on the face, to create the mass damping effect.

According to a still further aspect, the post has a first fixed end that is fixed to the sole of the body and second fixed end that is fixed to the crown of the body.

According to an additional aspect, the post is threaded and the first and second arms are threadably engaged with the post, such that the first and second arms are movable axially along the post by relative rotation between the post and the first and second arms. In one configuration, the post is supported by the body to be freely rotatable and the first and second arms are rotationally fixed, such that rotation of the post is configured to cause axial movement of the first and second arms with respect to the post. In another configuration, the first and second arms are freely rotatable with respect to the post, and the post is rotationally fixed, such that rotation of the first and second arms with respect to the post is configured to cause axial movement of the first and second arms with respect to the post.

According to other aspects, the first and second arms may be oriented at approximately 180° to each other, or the first and second arms may be configured such that an angle defined between the first and second arms is adjustable.

Additional aspects of the disclosure relate to ball striking devices, such as golf clubs, with a head that includes a face having striking surface configured for striking a ball, with the face having a heel portion and a toe portion, and a body connected to the face and extending rearwardly from the face, with the body having a crown, a sole, a heel side, and a toe side, such that the face and the body combine to define an enclosed internal cavity. A damping member is supported within the cavity, and the damping member includes a first arm positioned on the heel side of the body and a second arm positioned on the toe side of the body. A first abutment member is connected to the inner surface of the body and positioned within the cavity adjacent the first arm, with the first abutment member having a resilient material engaging a front surface of the first arm. A second abutment member is connected to the inner surface of the body and positioned within the cavity adjacent the second arm, with the second abutment member having a resilient material engaging a front surface of the second arm. The damping member is configured to create a mass damping effect upon an impact of the ball on the striking surface, such that the resilient material of the first abutment member is configured to be compressed by the first arm upon the impact on the heel portion of the face and the resilient material of the second abutment member is configured to be compressed by the second arm upon the impact on the toe portion of the face.

According to one aspect, the first arm further has a first weight member connected to the first arm and the second arm further has a second weight member connected to the second arm, where the first and second weight members have greater densities than the first and second arms.

According to another aspect, the first abutment member further has the resilient material engaging a rear surface of the first arm, and the second abutment member further has the resilient material engaging a rear surface of the second arm. In this configuration, the resilient material of the first abutment member is configured to be compressed by the first arm upon the impact on the toe portion of the face, and the resilient material of the second abutment member is configured to be compressed by the second arm upon the impact on the heel portion of the face, to further create the mass damping effect.

According to other aspects, the first and second arms may be oriented at approximately 180° to each other, or the first and second arms may be configured such that an angle defined between the first and second arms is adjustable.

According to a further aspect, the damping member further includes a substantially vertical post supported within the cavity, the post having a first end positioned adjacent the crown or sole, such that the post extends into the cavity from the first end. The first and second arms are connected to the post and extend from opposite sides of the post. In one configuration, the first end of the post is fixedly connected to the crown or sole. In another configuration, the head further includes a third abutment member connected to the inner surface of the body and positioned within the cavity adjacent the first end of the post, with the third abutment member having a resilient material engaging front and rear surfaces of the first end of the post. In this configuration, the third abutment member is configured such that the first end of the post is able to compress the resilient material of the third abutment member upon the impact of the ball on the striking surface, to further create the mass damping effect.

Further aspects of the disclosure relate to ball striking devices, such as golf clubs, with a head that includes a face having striking surface configured for striking a ball, and a body connected to the face and extending rearwardly from the face, with the body having a crown, a sole, a heel side, and a toe side, such that the face and the body combine to define an enclosed internal cavity. A damping member is connected to the body, with the damping member comprising a post having a first end positioned within the cavity and adjacent the sole and a second end positioned within the cavity and adjacent the crown. A first abutment member is connected to the sole and positioned within the cavity adjacent the first end of the post, and the first abutment member has a resilient material engaging a front surface of the first end of the post. A second abutment member is connected to the crown and positioned within the cavity adjacent the second end of the post, and the second abutment member has a resilient material engaging a front surface of the second end of the post. The damping member is configured to create a mass damping effect upon an impact on the face, such that the first end is configured to compress the resilient material of the first abutment member upon the impact on a lower portion of the face and the second end is configured to compress the resilient material of the second abutment member upon the impact on an upper portion of the face, producing a mass damping effect.

According to one aspect, the first abutment member further has the resilient material engaging a rear surface of the first end of the post, and the second abutment member further has the resilient material engaging a rear surface of the second end of the post. In this configuration, the resilient material of the first abutment member is configured to be compressed by the first end of the post upon the impact on the upper portion of the face, and the resilient material of the second abutment member is configured to be compressed by the second end of the post upon the impact on the lower portion of the face, to further produce the mass damping effect.

According to another aspect, the damping member further includes a first arm extending from the post toward the heel side of the body and a second arm extending from the post toward the toe side of the body, where the damping member is further configured to further produce the mass damping effect upon the impact on a toe portion or a heel portion of the face. In one configuration, a first weight member is connected to the first arm and a second weight member is connected to the second arm, where the first and second weight members have greater densities than the post. In another configuration, the head further includes a third abutment member connected to the inner surface of the body and positioned within the cavity adjacent the first arm, the third abutment member having a resilient material engaging a front surface of the first arm, and a fourth abutment member connected to the inner surface of the body and positioned within the cavity adjacent the second arm, the fourth abutment member having a resilient material engaging a front surface of the second arm. In this configuration, the resilient material of the third abutment member is configured to be compressed by the first arm upon the impact on the heel portion of the face, and the resilient material of the fourth abutment member is configured to be compressed by the second arm upon the impact on the toe portion of the face to produce the mass damping effect. In a further configuration, the third abutment member may further have the resilient material engaging a rear surface of the first arm, and the fourth abutment member may further have the resilient material engaging a rear surface of the second arm, such that the resilient material of the third abutment member is configured to be compressed by the first arm upon the impact on the toe portion of the face, and such that the resilient material of the fourth abutment member is configured to be compressed by the second arm upon the impact on the heel portion of the face, to further produce the mass damping effect.

Other aspects of the invention relate to a golf club or other ball striking device including a head or other ball striking device as described above and a shaft connected to the head/device and configured for gripping by a user. The shaft may be connected to the face member of the head. Aspects of the invention relate to a set of golf clubs including at least one golf club as described above. Yet additional aspects of the invention relate to a method for manufacturing a ball striking device as described above, including connecting a damping member to a club head as described above.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
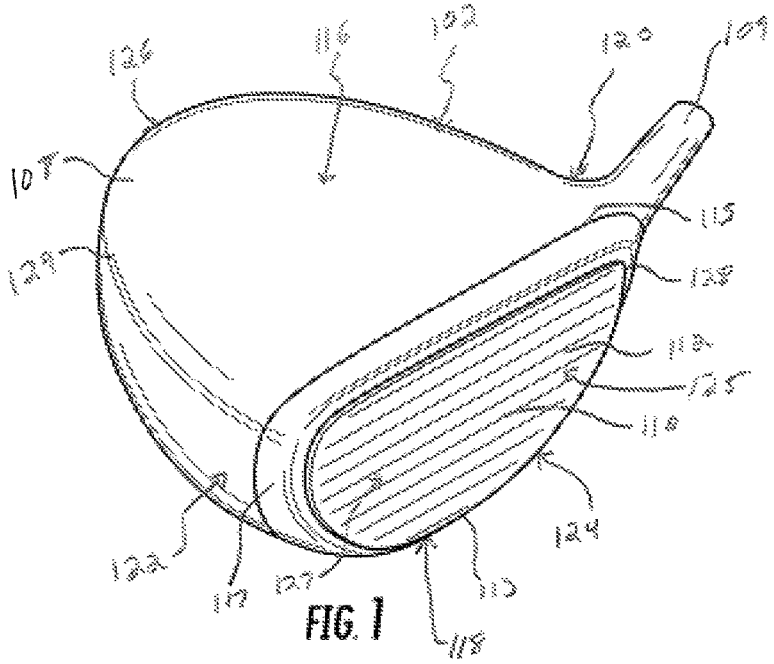
FIG. 1 is a top perspective view of one embodiment of a head for a ball striking device according to aspects of the present disclosure, in the form of a golf driver head.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs (including putters), croquet mallets, polo mallets, baseball or softball bats, cricket bats, tennis rackets, badminton rackets, field hockey sticks, ice hockey sticks, and the like.

"Ball striking head" or "head" means the portion of a "ball striking device" that includes and is located immediately adjacent (optionally surrounding) the portion of the ball striking device designed to contact the ball (or other object) in use. In some examples, such as many golf clubs, the ball striking head may be a separate and independent entity from any shaft or handle member, and it may be attached to the shaft or handle in some manner.

The term "shaft" includes the portion of a ball striking device (if any) that the user holds during a swing of a ball striking device, e.g., a handle.

"Integral joining technique" means a technique for joining two pieces so that the two pieces effectively become a single, integral piece, including, but not limited to, irreversible joining techniques, such as adhesively joining, cementing, welding, brazing, soldering, or the like. In many bonds made by "integral joining techniques," separation of the joined pieces cannot be accomplished without structural damage thereto.

"Approximately" or "about" means within a range of +/−10% of the nominal value modified by such term.

In general, aspects of this invention relate to ball striking devices, such as golf club heads, golf clubs, wood-type golf club heads, and the like. Such ball striking devices, according to at least some examples of the invention, may include a ball striking head and a ball striking surface. In the case of a golf club, the ball striking surface may constitute a substantially flat surface on one face of the ball striking head, although some curvature may be provided (e.g., "bulge" or "roll" characteristics). Some more specific aspects described herein relate to wood-type golf clubs and golf club heads, including drivers, fairway woods, hybrid-type clubs, although aspects described herein may also be utilized in putters and putter heads, as well as iron-type golf clubs, other types of golf clubs or other ball striking devices, if desired.

According to various aspects of this invention, the ball striking device may be formed of one or more of a variety of materials, such as metals (including metal alloys), ceramics, polymers, composites, fiber-reinforced composites, and wood, and the devices may be formed in one of a variety of configurations, without departing from the scope of the invention. In one embodiment, some or all components of the head, including the face and at least a portion of the body of the head, are made of metal materials. It is understood that the head also may contain components made of several different materials. Additionally, the components may be formed by various forming methods. For example, metal components (such as titanium, aluminum, titanium alloys, aluminum alloys, steels (such as stainless steels), and the like) may be formed by forging, molding, casting, stamping, machining, and/or other known techniques. In another example, polymer or composite components, such as carbon fiber-polymer composites or other fiber-reinforced polymers (FRPs), can be manufactured by a variety of composite processing techniques, such as prepreg processing, powder-based techniques, injection molding, mold infiltration, and/or other known techniques.

The various figures in this application illustrate examples of ball striking devices and portions thereof according to this invention. When the same reference number appears in more than one drawing, that reference number is used consistently in this specification and the drawings to refer to the same or similar parts throughout.

At least some examples of ball striking devices according to the invention relate to golf club head structures, including heads for wood-type golf clubs, such as drivers, fairway woods, etc. Other examples of ball striking devices according to the invention may relate to iron-type golf clubs, such as long iron clubs (e.g., driving irons, zero irons through five irons), short iron clubs (e.g., six irons through pitching wedges, as well as sand wedges, lob wedges, gap wedges, and/or other wedges), as well as hybrid clubs, putters, chippers, and other types of clubs. Such devices may include a one-piece construction or a multiple-piece construction. Example structures of ball striking devices according to this invention will be described in detail below in conjunction with FIGS. 1-36, which illustrate examples of ball striking devices in the form of golf drivers and will be referred to generally using reference numeral "100."

FIGS. 1-5 illustrate a ball striking device 100 in the form of a golf driver, in accordance with at least some examples of the invention, and FIGS. 6-36 illustrate various additional embodiments of a golf driver or other wood-type golf club in accordance with aspects of the invention. As shown in FIGS. 1-5, the ball striking device 100 includes a ball striking head 102 and a shaft 104 connected to the ball striking head 102 and extending therefrom. The ball striking head 102 of the ball striking device 100 of FIGS. 1-5 has a face 112 connected to a body 108, with a hosel 109 extending therefrom. For reference, the head 102 generally has a top or crown 116, a bottom or sole 118, a heel or heel side

120 proximate the hosel 109, a toe or toe side 122 distal from the hosel 109, a front 124, and a back or rear 126. The shape and design of the head 102 may be partially dictated by the intended use of the device 100. In the club 100 shown in FIGS. 1-5, the head 102 has a relatively large volume, as the club 100 is designed for use as a driver, intended to hit a ball (not shown) accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. If instead configured as a fairway wood, the head may have a volume of 120 cc to 230 cc, and if configured as a hybrid club, the head may have a volume of 85 cc to 140 cc. Other appropriate sizes for other club heads may be readily determined by those skilled in the art.

In the embodiment illustrated in FIGS. 1-5, the head 102 has a hollow structure defining an inner cavity 107 (e.g., defined by the face 112 and the body 108). Thus, the head 102 has a plurality of inner surfaces defined therein. In one embodiment, the inner cavity 107 may be filled with air. However, in other embodiments, the head 102 could be filled with another material, such as foam. In still further embodiments, the solid materials of the head may occupy a greater proportion of the volume, and the head may have a smaller cavity 107 or no inner cavity at all. It is understood that the inner cavity 107 may not be completely enclosed in some embodiments. In the embodiment as illustrated in FIGS. 1-5, the body 108 of the head 102 has a rounded rear profile. In other embodiments, the body 108 of the head 102 can have another shape or profile, including a squared or rectangular rear profile, or any of a variety of other shapes. It is understood that such shapes may be configured to distribute weight away from the face 112 and/or the geometric/volumetric center of the head 102, in order to create a lower center of gravity and/or a higher moment of inertia. The body 108 may be connected to the hosel 109 for connection to a shaft 104, as described below.

Figure 4:
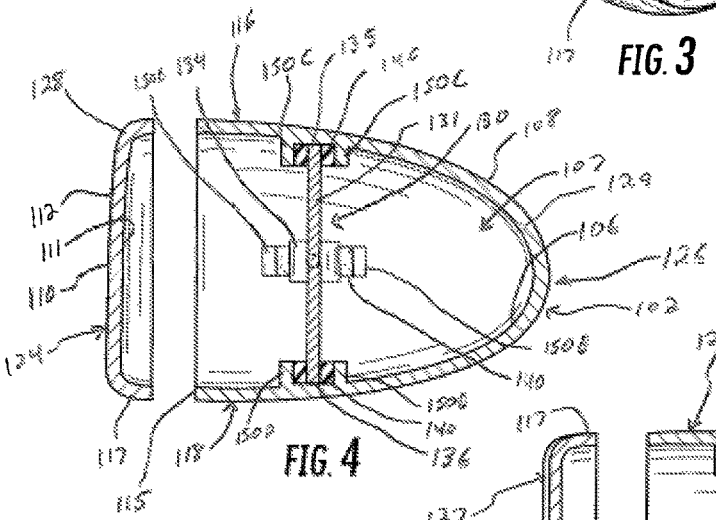
FIG. 4 is a cross-section view taken along lines 4-4 of FIG. 3.
Figure 5:
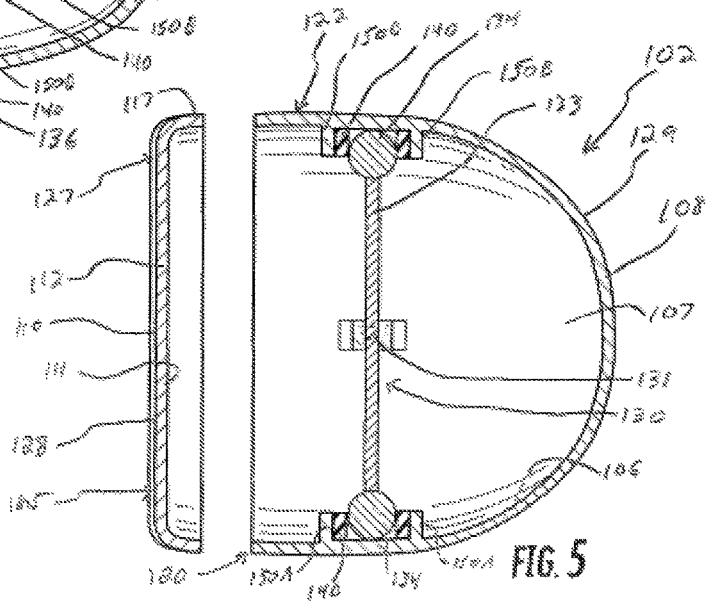
FIG. 5 is a cross-section view taken along lines 5-5 of FIG. 3.

The face 112 is located at the front 124 of the head 102, and has a ball striking surface or striking surface 110 located thereon and an inner surface 111 opposite the ball striking surface 110, as shown in FIGS. 4-5. The ball striking surface 110 is typically an outer surface of the face 112 configured to face a ball in use, and is adapted to strike the ball when the device 100 is set in motion, such as by swinging. The face 112 is defined by peripheral edges or face edges 113, including a top edge, a bottom edge, a heel edge, and a toe edge. Additionally, in this embodiment, the face 112 has a plurality of face grooves 121 on the ball striking surface 110.

As shown, the ball striking surface 110 is relatively flat, occupying most of the face 112. For reference purposes, the portion of the face 112 nearest the top face edge 113 and the heel 120 of the head 102 is referred to as the "high-heel area"; the portion of the face 112 nearest the top face edge 113 and toe 122 of the head 102 is referred to as the "high-toe area"; the portion of the face 112 nearest the bottom face edge 113 and heel 120 of the head 102 is referred to as the "low-heel area"; and the portion of the face 112 nearest the bottom face edge 113 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. Additionally, the face 112 may be considered to have a heel portion 125 and a toe portion 127 positioned on opposite sides of the CG of the face 112, toward the heel 120 and toe 122, respectively. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIGS. 1-5, the ball striking surface 110 is inclined slightly (i.e., at a loft angle), to give the ball slight lift and spin when struck. In other illustrative embodiments, the ball striking surface 110 may have a different incline or loft angle, to affect the trajectory of the ball. Additionally, the face 112 may have a variable thickness and/or may have one or more internal or external inserts in some embodiments.

It is understood that the face 112, the body 108, and/or the hosel 109 can be formed as a single piece or as separate pieces that are joined together. In one embodiment, the face 112 may be wholly or partially formed by a face member 128 with the body 108 being partially or wholly formed by a body member 129 including one or more separate pieces connected to the face member 128, as in the embodiment shown in FIGS. 1-5, for example. In this embodiment, the body member 129 has a front edge 115 defining an opening 123, and the face member 128 is in the form of a "cup face" member, i.e., having a wall or walls 117 extending rearwardly from the face 112, where the front edge 115 of the body member 129 is connected to the wall(s) 117 of the face member 128. The wall(s) 117 of the face member 128 of FIGS. 1-5 are shown extending around the entire periphery of the face 112 to form the cup face structure. In other embodiments, the face member 128 may have wall(s) 117 extending around only a portion of the periphery thereof.

Figure 6:
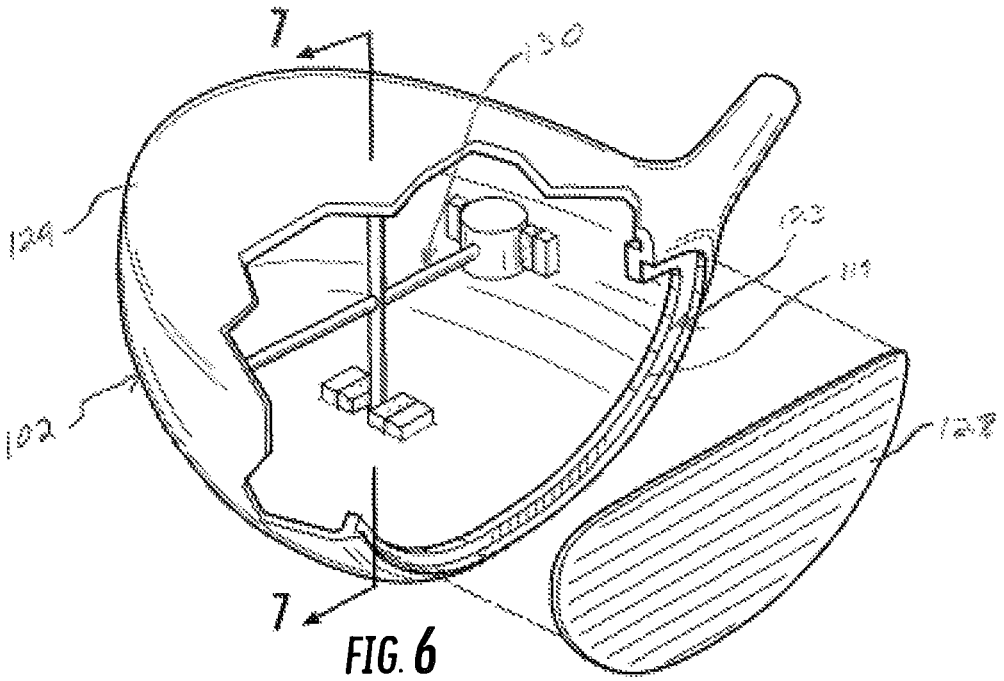
FIG. 6 is a partially exploded and broken away perspective view of another embodiment of a head for a ball striking device according to aspects of the present disclosure, in the form of a golf driver head.
Figure 7:
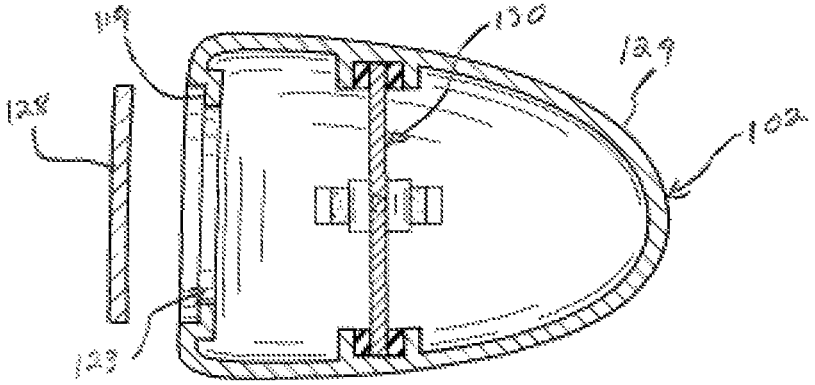
FIG. 7 is a cross-section view taken along lines 7-7 of FIG. 6.

The body member 129 and the face member 128 are shown as being connected at a butt joint in FIGS. 1-5, such as by welding, bonding, or other integral joining technique, fasteners, etc. In other embodiments, different joints may be used to connect the front edge 115 of the body member 129 to the wall(s) 117 of the face member 128, such as a lap or dovetail joint, or other interlocking and/or overlapping joints. Different joining techniques may be used as well, including various interlocking structures, friction or interference fit connection, etc. In another embodiment, shown in FIGS. 6-7, the face member 128 is in the form of a plate member, and the opening 123 defined by the front edge 115 of the body member 129 is dimensioned to receive the face member 128 therein. Additionally, in this embodiment, the front edge 115 of the body member 129 has a recessed flange 119 within the opening 123, which engages and supports the face member 128 within the opening 123. The flange 119 may be continuous or discontinuous in various different configurations. The face member 128 in FIGS. 6-7 may be joined to the body member 129 using any of the joining techniques described herein. The structure and functionality of the head 102 in the embodiment of FIGS. 6-7 is otherwise similar or identical to that of the embodiment in FIGS. 1-5 described herein. The structure and connection of the face member 128 and the body member 129 are described in further detail elsewhere herein.

In other embodiments, the face member 128 and the body member 129 may be connected in another manner, such as using other known techniques and structures for joining. For example, one or more of a variety of mechanical joining techniques may be used, including fasteners and other releasable mechanical engagement techniques. The hosel 109 in the embodiments of FIGS. 1-7 is connected directly to the body member 129, but if desired, the hosel 109 may be connected directly to the face member 128 instead. In further embodiments, the face member 128 and/or the body member 129 may have a different configuration, or the face 112 and the body 108 may be integrally formed, such that separately formed face and body members are not used. In an additional embodiment, the face member 128 and the body member 129 may be connected using a removable connecting structure to permit removal of the face member 128 from the body member 129, such as to access internal components of the head 102. Such removable connections may include fasteners, interlocking structures, snap-fit or friction-fit joints, etc. Further, a gasket (not shown) may be included between the face member 128 and the body member 129 in some embodiments.

In one embodiment, the face member 128 and the body member 129 may be formed of different materials. For example, one of the face and body members 128, 129 may be formed of a metallic material, e.g., a metal, metal alloy, metal matrix composite, etc., and the other may be formed of a polymer-based material (i.e., plastic and/or polymeric material), e.g., various plastics, polymers, and copolymers or other mixes thereof, an FRP or other polymer-matrix composite, etc. In one embodiment, a metallic face member 128 may be joined to a plastic or FRP body member 129, and in another embodiment, a plastic or FRP face member 128 may be joined to a metallic body member 129. As another example, the face or body member 128, 129 may be formed of a different type of material, e.g., ceramic materials, wood, etc. In further embodiments, the face 112 and/or the body 108 may be defined by multiple members made from different materials. In one embodiment (not shown), the face member 128 may have a face insert made from a different material from the rest of the face member 128. The body member 129 may similarly have a portion made from a different material in one embodiment.

Figure 2:
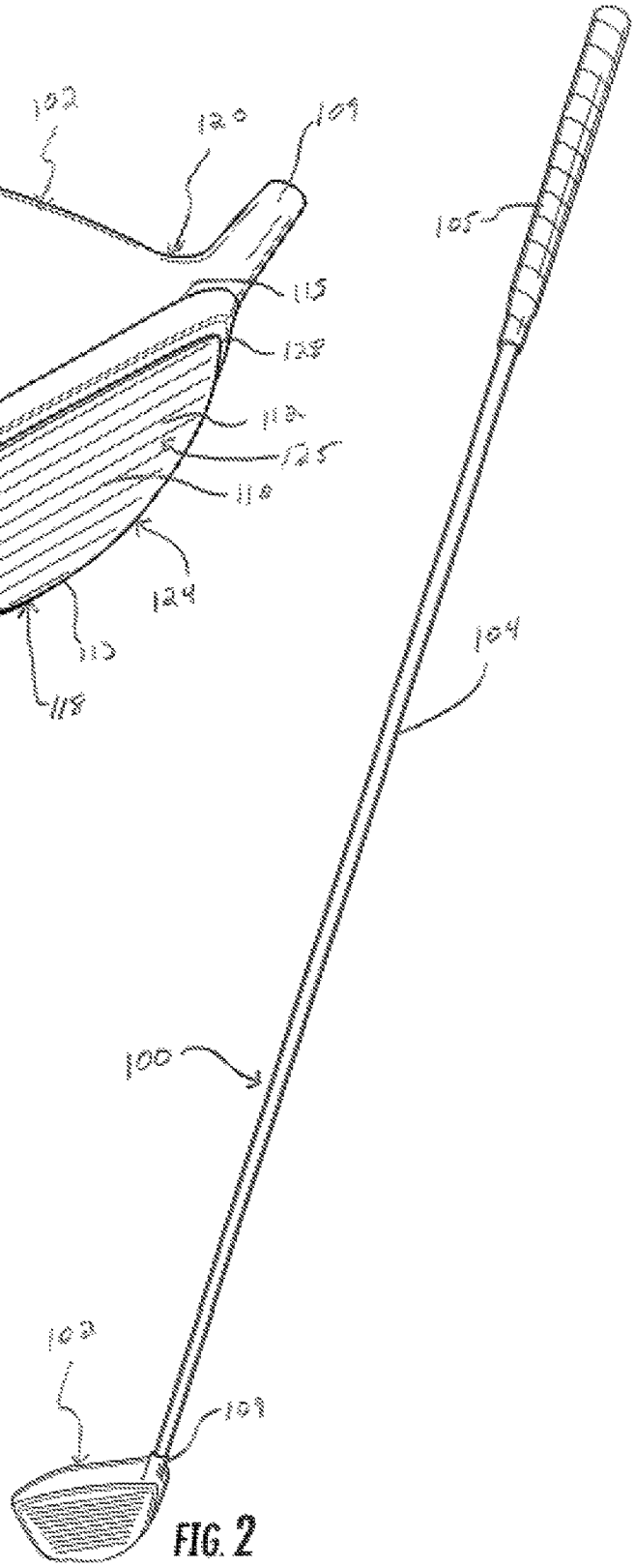
FIG. 2 is a front view of a ball striking device including the head of FIG. 1, in the form of a golf driver.

The ball striking device 100 may include a shaft 104 connected to or otherwise engaged with the ball striking head 102, as shown in FIG. 2. The shaft 104 is adapted to be gripped by a user to swing the ball striking device 100 to strike the ball. The shaft 104 can be formed as a separate piece connected to the head 102, such as by connecting to the hosel 109, as shown in FIG. 2. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Patent Application Publication No. 2009/0062029, filed on Aug. 28, 2007, U.S. Patent Application Publication No. 2013/0184098, filed on Oct. 31, 2012, and U.S. Pat. No. 8,533,060, issued Sep. 10, 2013, all of which are incorporated herein by reference in their entireties and made parts hereof. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention.

The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 105 may be positioned on the shaft 104 to provide a golfer with a slip resistant surface with which to grasp golf club shaft 104, as shown in FIG. 2. The grip element 105 may be attached to the shaft 104 in any desired manner, including in conventional manners known and used in the art (e.g., via adhesives or cements, threads or other mechanical connectors, swedging/swaging, etc.).

In general, the head 102 of the ball striking device 100 has a damping member 130 connected to an inner surface 106 defining the cavity 107 and located behind the face 112. The damping member 130 may be connected to the body 108 and/or the body member 129 and extend into the cavity 107 in one embodiment. In general, the damping member 130 is configured to create a mass damping effect upon impact of the ball on the striking surface 110, including an off-center impact. The damping member 130 may be connected to the body 108 and/or body member 129 in a number of different configurations that permit the damping member 130 to create the mass damping effect, several of which are described below and shown in the FIGS. For example, the damping member 130 may create a mass damping effect through compression of a resilient material 140 and/or through a "torsion bar" mechanism, according to some embodiments described herein, as well as other structural configurations. In other embodiments, the damping member 130 may be differently configured, and/or the head 102 may contain multiple damping members 130 having similar or different configurations. The damping member 130 in all embodiments may affect or influence the center of gravity (CG) of the head 102. Additionally, the damping member 130 (and other weighted members described herein) may be made of any of a variety of different materials, which may be selected based on their weight or density, and the damping member 130 in one embodiment is made from a combination of different materials having different densities at selected locations. For example, the damping member 130 may be made from metallic materials of different densities (e.g., aluminum, titanium, stainless steel, tungsten, etc.), polymeric materials that may be doped in some locations with a heavier material (e.g. tungsten), various ceramic materials, and combinations of such materials. The damping member 130 may also include portions that may be more heavily weighted than others, and may include weighted inserts or other inserts.

The damping member 130 may have various different dimensions and structural properties in various embodiments. In one embodiment, as illustrated in FIGS. 1-5, the damping member 130 may have a configuration that includes an elongated post 131 extending inwardly into the cavity 107 from the inner surface 106 of the body 108, a first arm 132 extending from the post 131 toward the heel side 120 of the body 108, and a second arm 133 extending from the post 131 toward the toe side 122 of the body 108. Each embodiment in FIGS. 1-38 includes this general configuration, with different structures in different embodiments.

In the embodiment shown in FIGS. 1-5, the damping member 130 is not rigidly connected to the body 108 at any point, and is supported within the cavity 107 by a plurality of abutment members 150 connected to the inner surface 106 of the body 108. Generally, the first arm 132 is configured to engage one or more heel abutment members 150A on the inner surface 106 of the heel 120, and the second arm 133 is configured to engage one or more toe abutment members 150B on the inner surface 106 of the toe 122, so that the arms 132, 133 extend from the post 131 laterally across the cavity 107. Additionally, the post 131 is configured to engage one or more top abutment members 150C on the inner surface 106 of the crown 116 and one or more bottom abutment members 150D on the inner surface 106 of the sole 118, so that the post 131 extends across the cavity 107 in a vertical or substantially vertical direction. The embodiment shown in FIGS. 1-5 has a pair of bottom abutment members 150D engaging the front and rear sides of the bottom end 136 of the post 131, a pair of top abutment members 150C engaging the front and rear sides of the top end 135 of the post 131, a pair of heel abutment members 150A engaging the front and rear sides of the first arm 132, and a pair of toe abutment members 150B engaging the front and rear sides of the second arm 133. It is understood that only one of the front and rear abutment members 150 may be present at each location in one embodiment. The abutment members 150 in this embodiment are connected to the body member 129, but one or more abutment members 150 may be connected to the face member 128 in another embodiment, depending on the configuration of the head 102 and the positions of the abutment members 150. It is also understood that the pair of abutment members 150 may be separate members as depicted in FIGS. 1-5, or may alternately be integrally formed with each other or otherwise connected to each other to form a single structure in another embodiment.

The head 102 may have a resilient material 140 positioned between each abutment member 150 and the portion of the damping member 130 engaging each abutment member 150. In the embodiment of FIGS. 1-5, each of the abutment members 150 has a resilient material 140 on the surface facing the respective arm 132, 133, such that the resilient material 140 is configured to engage the arm 132, 133, and such that the arm 132, 133 is configured to compress the resilient material 140 between the arm 132, 133 and the abutment member 150. For example, the first arm 132 is configured to engage and compress the resilient material 140 on the front heel abutment member 150A on an impact on the heel portion 125 of the face 112, and the first arm 132 is configured to engage and compress the resilient material 140 on the rear heel abutment member 150A on an impact on the toe portion 127 of the face 112. The second arm 132 engages and compresses the resilient material 140 of the toe abutment members 150B in this same manner, and the top and bottom ends 135, 136 of the post 131 engage and compress the resilient material of the top and bottom abutment members 150C,D in this same manner as well. In the embodiment in FIGS. 1-5, as well as the embodiments in FIGS. 6-19, each abutment member 150 has the resilient material 140 formed as a separate, integral resilient member connected to the abutment member 150. In other embodiments, the front and rear abutment members 150 of each pair may include a single piece of resilient material 140 covering both abutment members 150, or each abutment member 150 may have a greater number of pieces of the resilient material 140. It is understood that an adhesive or other bonding material may be utilized to connect the resilient material 140 to the abutment member(s) 150, and that other connection techniques may be used in other embodiments, such as mechanical fasteners, interlocking designs (e.g. dovetail, tab and slot, etc.) and others.

In an alternate embodiment, the resilient material 140 may be connected to the damping member 130 in some or all locations, instead of the abutment member(s) 150, to place the resilient material 140 between the abutment member(s) and the corresponding portion(s) of the damping member 130. For example, the arms 132, 133 and/or the top or bottom ends 135, 136 of the post 131 in the head 102 of FIGS. 1-5 may have the resilient material 140 connected thereto. Thus, in one general embodiment, the head 102 may be configured such that the resilient material 140 is positioned between each abutment member 150 and the corresponding portions of the damping member 130, and may be connected to at least one of the abutment member and the damping member. In a further embodiment, the head 102 may include one or more abutment members 150 that do not have a resilient material 140, and the abutment member(s) 150 and/or the arms 132, 133 themselves may have sufficient resiliency to achieve mass damping as described herein.

Figure 3:
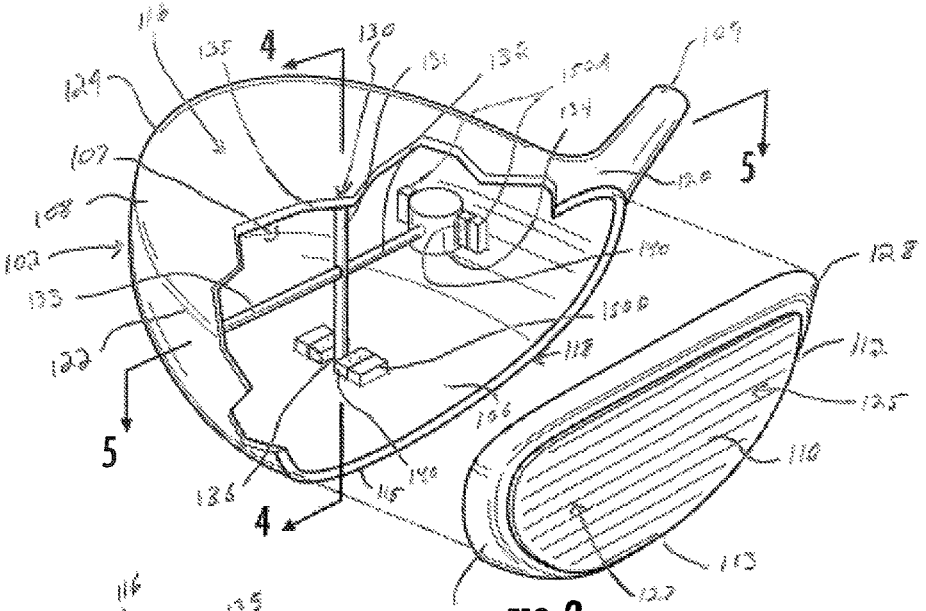
FIG. 3 is a partially exploded and broken away perspective view of the head of FIG. 1.
Figure 31:
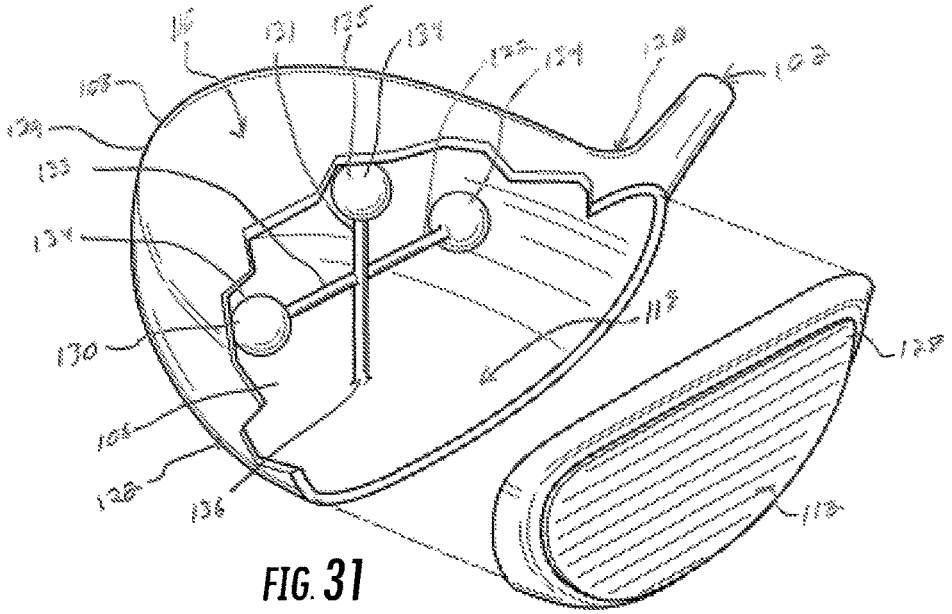
FIG. 31 is a partially exploded and broken away perspective view of another embodiment of a head for a ball striking device according to aspects of the present disclosure, in the form of a golf driver head.
Figure 32:
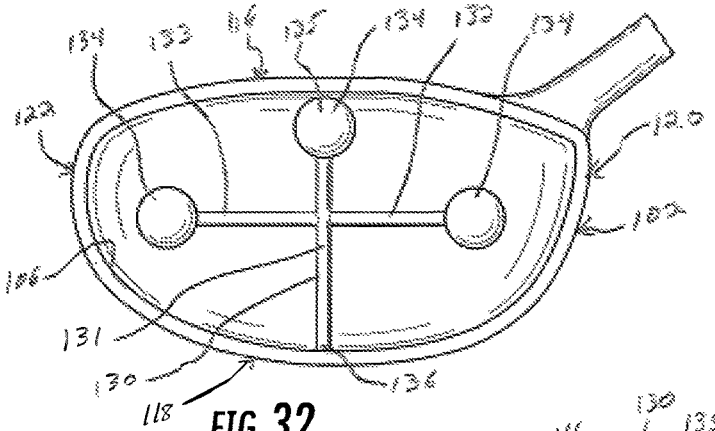
FIG. 32 is a broken away front view of the head of FIG. 31.
Figure 33:
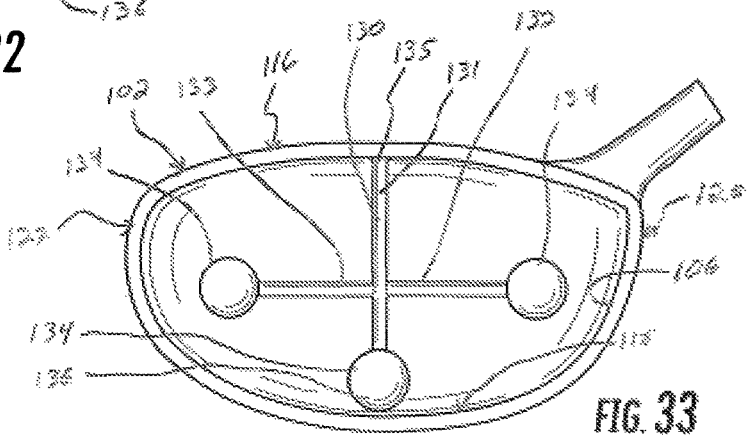
FIG. 33 is a broken away front view of another embodiment of a head for a ball striking device according to aspects of the present disclosure, in the form of a golf driver head.

The first and second arms 132, 133 may include weight members 134 in one embodiment, as illustrated in FIGS. 3-5. Each embodiment in FIGS. 1-38 shows a damping member 130 with arms 132, 133 that include weight members 134, with different structures shown in different embodiments. In general, the weight members 134 achieve the function of distributing the weight of the damping member 130 toward the periphery of the club head 102. The weight members 134 may have any suitable shape, size, or density, and may be weighted heavier or lighter based on the flexing properties of the resilient material 140 and/or the flexing properties of the post 131. In other words, heavier weights may be used for a less flexible resilient material 140, and lighter weights may be used for a more flexible resilient material 140, in some embodiments. In a post that has a "torsion bar" function as described below, heavier weights may be used for a less flexible post 131, and lighter weights may be used for a more flexible post 131, in some embodiments. The weight members 134 in the embodiment of FIGS. 1-5 are fixedly connected at the ends of the arms 132, 133, and the weight members 134 form the portions of the arms 132, 133 that engage the abutment members 150A,B. In other embodiments, such as in FIGS. 37-38 (described elsewhere herein in greater detail), the weight members 134 may be removable and interchangeable and/or may be movable along the arms 132, 133. It is understood that these removable, interchangeable, and/or adjustable configurations may be used with any embodiment described herein. Additionally, the post 131 in the club head 102 of FIGS. 1-5 may include weight members 134 on the top and/or bottom ends 135, 136, similar to the weight members 134 on the arms 132, 133, in another embodiment, such as shown in FIGS. 31-33. This periphery-weighted configuration can achieve greater weight distribution around the periphery and increased moment of inertia for the club head 102, as well as enhancing the capability of the damping member 130 to create a mass damping effect upon impact. Further, the damping member 130 in one embodiment may be positioned so that the CG of the damping member 130 is substantially aligned with the CG of the face 112 and/or the CG of the head 102 overall. For example, in one embodiment, the CG of the damping member 130 is laterally aligned with the CG of the face 112 and/or the CG of the head 102, and these respective CGs may additionally or alternately be vertically aligned in another embodiment. In the embodiments of FIGS. 1-38 illustrated herein, the CG of the damping member 130 is at least laterally aligned with the CG of the face 112 and/or the CG of the head 102, subject to adjustability features as described herein.

The damping member 130 (and the weight members 134 thereof) and the abutment members 150 in the embodiment of FIGS. 1-5 are generally positioned symmetrically with respect to the CG of the head 102 and/or the CG of the face 112. In other embodiments, the damping member 130 and the abutment members 150 may be positioned asymmetrically with respect to these CGs. Additionally, the damping member 130 and/or the abutment member(s) 150 may be at least partially formed of lightweight materials in one embodiment, such as FRP or other high-strength polymers. Constructing these components of lightweight materials minimizes the proportion of the total weight of the club head 102 that is occupied by these components. The damping member 130 and/or the abutment member(s) 150 may be formed of different materials in other embodiments. In one embodiment, the weight of the damping member 130 may be no more than 7% of the total weight of the head 102.

The resilient material 140 according to one embodiment may be a natural or synthetic rubber material, a polyurethane-based elastomer, or other elastomeric material in one embodiment, but may be a different type of resilient material in another embodiment, including various types of resilient polymers, such as foam materials or other rubber-like materials. Additionally, the resilient material 140 may have resiliency, such that the resilient material 140 compresses in response to an applied force, and returns to its previous (uncompressed) state when the force is removed. The resilient material 140 may further have some viscoelasticity, such that energy may be lost in returning to the uncompressed state. The resilient material 140 may have a strength or hardness that is lower than, and may be significantly lower than, the strength/hardness of the material(s) of the face member 128, the body member 129, the abutment member(s) 150, or other components of the club head 102. In one embodiment, the resilient material 140 may have a hardness of approximately 70 Shore A to approximately 70 Shore D. The hardness may be determined, for example, by using ASTM D-2240 or another applicable test with a Shore durometer. In some example embodiments, the resilient material 140 may be a polyurethane-based elastomer or an epoxy-based material with a hardness of approximately 70-80 Shore D. Additionally, in one embodiment, the resilient material 140 may have sufficient resiliency to achieve at least half of a mass damping cycle before the ball leaves the face 112 during impact. Further, the resilient material 140 may be any material described in U.S. Patent Application Publication No. 2013/0137533, filed Nov. 30, 2011, which application is incorporated by reference herein in its entirety and made part hereof.

The resilient material 140 may have a hardness and/or a modulus that is significantly smaller than the material(s) forming the face 112 and the body 108. For example, in one embodiment, a resilient material as described herein (e.g., polyurethane or elastomer) may have a modulus (Young's) of up to 5000 MPa or 1000-5000 MPa, in various embodiments. Metal materials that may be utilized to make the face and/or body in one embodiment (e.g., stainless steel or titanium alloys) may have a modulus of 100-200 GPa. In various embodiments, a metallic material of the face 112 (or face member 128) and/or the body 108 (or body member 129) may have a modulus that is at least 20× greater, at least 50× greater, or at least 100× greater than the modulus of the resilient material 140. An FRP or other composite material that may be utilized to make the face 112 and/or body 108 in one embodiment (e.g., carbon fiber reinforced epoxy) may have a modulus of at least 50 GPa. In various embodiments, a composite material of the face 112 (or face member 128) and/or the body 108 (or body member 129) may have a modulus that is at least 10× greater, at least 20× greater, or at least 50× greater than the modulus of the resilient material 140. It is understood that the metallic and composite materials described above may form a portion, a majority portion, or the substantial entirety of the face 112 (or face member 128) or body 108 (or body member 129). Other materials having other moduli may be used in other embodiments.

The properties of the resilient material 140, such as hardness (or modulus) and/or resiliency, may be designed for use in a specific configuration. For example, the hardness and/or resiliency of the resilient material 140 may be designed to ensure that an appropriate degree of mass damping is created, which may be influenced by parameters such as material thickness, mass and mass distribution of various components (including the damping member 130, the body member 129, and/or the face member 128), intended use of the head 102, and others. The hardness and resiliency may be achieved through techniques such as material selection and any of a variety of treatments performed on the material that can affect the hardness or resiliency of the resilient material, as discussed elsewhere herein. The hardness and thickness of the resilient material may be tuned to the weight and/or flexural properties of a particular damping member 130. For example, heavier weights and/or more flexible damping members 130 may require harder resilient material 140, and lighter weights and/or stiffer damping members 130 may require softer resilient material 140. Using a thinner resilient material 140 may also necessitate the use of a softer material, and a thicker resilient material 140 may be usable with harder materials. In a configuration where the resilient material 140 is a polyurethane-based material having a hardness of approximately 65 Shore A, the resilient material 140 may have a thickness of approximately 5 mm in one embodiment, or approximately 3 mm in another embodiment, and generally greater than approximately 1 mm (e.g., approximately 1-5 mm or 1-3 mm). In a configuration where the resilient material 140 is an epoxy-based material, the resilient material 140 may have a thickness of approximately 0.5-3.0 mm in one embodiment.

The pieces of the resilient material 140 may be formed of multiple components as well, including components having different hardness in different regions, including different hardness distributions. For example, the resilient material 140 may be formed of an exterior shell that has a different (higher or lower) hardness than the interior, such as through being made of a different material (e.g. through co-molding) and/or being treated using a technique to achieve a different hardness. Examples of techniques for achieving a shell with a different hardness include plasma or corona treatment, adhesively bonding a film to the exterior, coating the exterior (such as by spraying or dipping), etc. If a cast or other polyurethane-based material is used, the resilient material 140 may have a thermoplastic polyurethane (TPU) film bonded to the exterior, a higher or lower hardness polyurethane coating applied by spraying or dipping, or another polymer coating (e.g. a thermoset polymer), which may be applied, for example, by dipping the resilient material into an appropriate polymer solution with an appropriate solvent. Additionally, the head 102 may utilize resilient materials 140 with different hardness or compressibility in different locations, which can create different mass damping effects in such different locations. For example, one abutment member 150 may have a resilient material 140 with greater or smaller flexibility and/or thickness than another abutment member 150, or the front portion of a single abutment member 150 may have a resilient material with greater or smaller flexibility and/or thickness than the rear portion thereof. These resilient materials 140 having different flexibilities may be achieved by techniques described herein, such as treatments, use of different materials, etc. Further, the hardness of the resilient material 140, or the use of resilient materials 140 having different flexibility in different locations, may be customized for use by a particular golfer or a particular golfer's hitting pattern and/or to create different mass damping effects. Resilient materials 140 having different thicknesses may be used in different locations for similar purposes. It is understood that if an abutment member 150 is formed of a polymer material, the abutment member 150 and the corresponding resilient material 140 may be formed together through a co-molding process.

The damping member 130 may be configured such that a mass damping effect is created during impact, including an off-center impact on the striking surface 110. The resilient material 140 and the abutment member(s) 150 can serve to enable this mass damping effect between the damping member 130 and the face 112 during impact. Additionally, the damping member 130 may also be configured to resist deflection of the face 112 upon impact of the ball on the striking surface 110. The stiffness of the damping member 130 and the resiliency and compression of the resilient material 140 permits this mass damping effect to be created by the damping member 130. As described above, the damping member 130 compresses the resilient material 140, causing the resilient material 140 and the abutment member(s) 150 to create this mass damping effect. The resilient material 140 may compress and return to its uncompressed, or even beyond its uncompressed state, repeatedly after impact. Each compression-decompression cycle will be generally smaller than a previous cycle, if applicable, as a result of hysteresis losses within the resilient material 140, resulting in the mass damping effect. The damping member 130 creates this mass damping effect at the abutment members 150, i.e., at the connection points between the abutment members 150 and the body 108. This effect is transferred to the face 112 through the connection between the body 108 and the face 112.

For example, in this embodiment, upon an off-center impact of the ball located toward the heel 120 or toe 122, the face 112 tends to twist and deflect rearwardly at the heel 120 or toe 122. As the face 112 begins to deflect rearwardly, the mass damping effect created by the damping member 130 resists this deflection, as described above. In the embodiment of FIGS. 1-5, on a heel-side impact, at least some of the mass damping effect is created by the first arm 132 of the damping member 130 engaging the front heel abutment member 150A (and the resilient material 140 thereof) during impact. The first arm 132 of the damping member 130 may resist rearward movement of the heel portion 125 of the face 112, and the second arm 133 of the damping member 130 may resist forward movement of the toe portion 127 of the face 112 in this situation. Likewise, on a toe-side impact, at least some of the mass damping effect is created by the second arm 133 of the damping member 130 engaging the front toe abutment member 150B (and the resilient material 140 thereof) during impact. The second arm 133 of the damping member 130 may resist rearward movement of the toe portion 127 of the face 112, and the first arm 132 of the damping member 130 may resist forward movement of the heel portion 125 of the face 112 in this situation. The arms 132, 133 may also engage the resilient material 140 of the rear heel or toe abutment member 150A,B, to enhance the mass damping effect on a toe side or heel side impact, respectively. It is understood that the forces exerted between the face 112 and the damping member 130 are exerted on the portions of the body 108 located between the face 112 and the abutment member(s) 150. The actions achieving the mass damping effect occur between the beginning and the end of the impact, which in one embodiment of a golf driver may be between 4-5 ms.

As described above, it is understood that the degree of potential moment causing deflection of the face 112 may increase as the impact location diverges from the CG the face 112 and/or the CG of the head 102. In one embodiment, the mass damping effect created by the damping member 130 may also increase as the impact location diverges from the center of gravity of the face 112, to provide increased resistance to such deflection of the face 112. In other words, the mass damping effect created by the damping member 130, e.g., the force exerted on the abutment member(s) 150 by the damping member 130 through the resilient material 140, may be incremental and directly relative/proportional to the distance the impact is made from the optimal impact point (e.g. the lateral center point of the striking surface 110 and/or the CGs of the face/head, in exemplary embodiments). Thus, the mass damping effect of the damping member 130 increases incrementally in the direction in which the ball makes contact away from the center of gravity of the head 102. This mass damping effect can reduce the degree of twisting of the face 112 and keep the face 112 more square upon impacts, including off-center impacts. Additionally, this mass damping effect can minimize energy loss on off-center impacts, resulting in more consistent ball distance on impacts anywhere on the face 112.

In the embodiment of FIGS. 1-5, the damping member 130 can also create a mass damping effect on impacts that are above or below the CG of the face 112 and/or the CG of the head 102, in a mechanism similar to that described above with respect to heel or toe side impacts. For example, during impacts high on the face 112, the top end 135 of the post 131 may compress the resilient material 140 on the front top abutment member 150C, creating a mass damping effect as similarly described above. The bottom end 136 of the post 131 may compress the resilient material 140 on the rear bottom abutment member 150D during this impact as well. As another example, during impacts low on the face 112, the bottom end 136 of the post 131 may compress the resilient material 140 on the front bottom abutment member 150D, creating a mass damping effect as similarly described above. The top end 135 of the post 131 may compress the resilient material 140 on the rear top abutment member 150C during this impact as well. It is understood that the top and/or bottom ends 135, 136 of the post 131 in FIGS. 1-5 may have weight members (not shown) similar to the weight members 134 on the arms 132, 133 in any embodiment described herein, in order to enhance this mass damping effect.

FIGS. 8-38 illustrate additional embodiments of ball striking heads in the form of a wood-type golf club head 102, which contains many components, features, and properties that are similar to the features described above with respect to the heads 102 of FIGS. 1-7. Description of some such similar or shared components, features, and/or properties that have already been described above may be simplified or eliminated for the sake of brevity in the description below. Thus, the embodiments of FIGS. 8-38 are generally described herein with respect to the differences that exist between such club heads 102 and the embodiments of FIGS. 1-7, and it can be assumed that components, features, and properties that are not described herein with respect to the embodiments in FIGS. 8-38 may be configured similarly to those described above with respect to FIGS. 1-7. For example, it is noted that any of the embodiments of FIGS. 8-38 may include damping members 130 that are positioned and oriented with respect to the CGs of the head 102 and/or the face 112 in any manner described above with respect to FIGS. 1-7.

Figure 8:
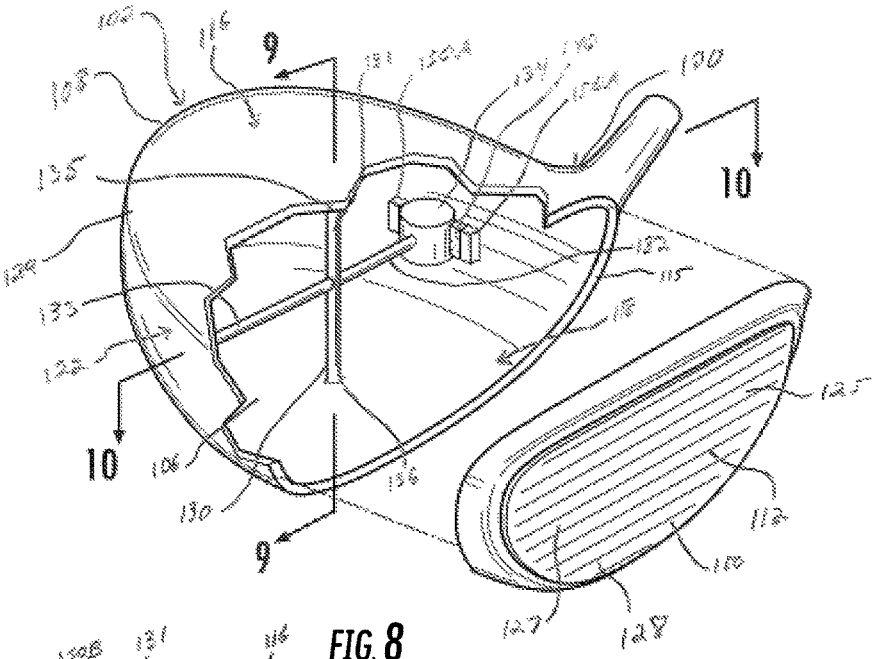
FIG. 8 is a partially exploded and broken away perspective view of another embodiment of a head for a ball striking device according to aspects of the present disclosure, in the form of a golf driver head.
Figure 9:
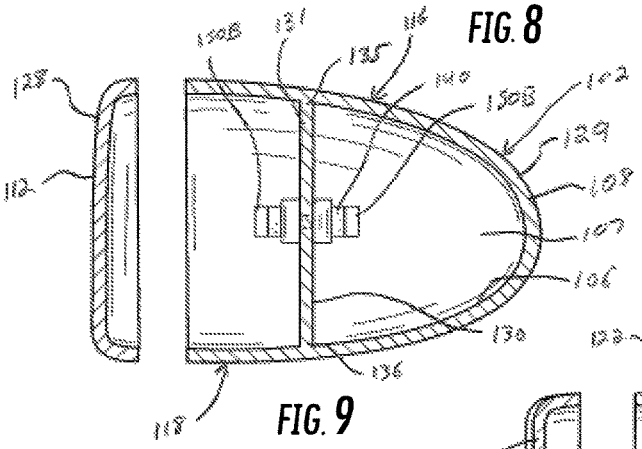
FIG. 9 is a cross-section view taken along lines 9-9 of FIG. 8.
Figure 10:
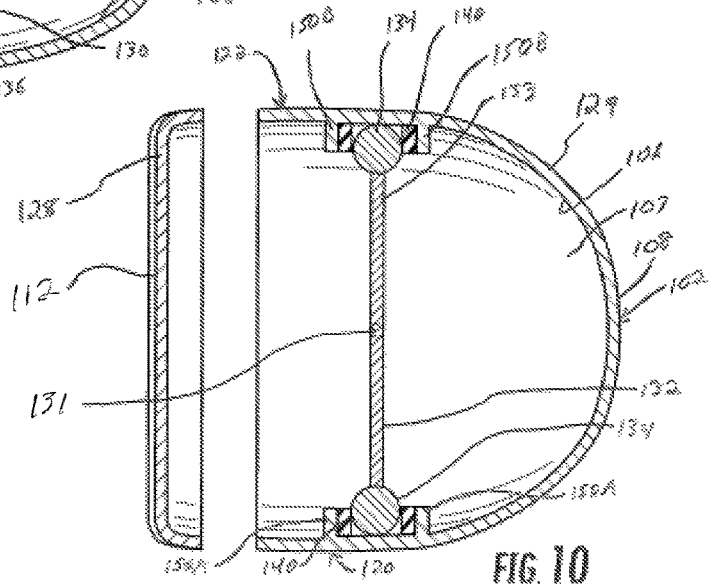
FIG. 10 is a cross-section view taken along lines 10-10 of FIG. 8.

The club head 102 in the embodiment of FIGS. 8-10 is structurally similar to the club head 102 described above with respect to FIGS. 1-7, and generally may include any of the features (including alternate embodiments) described herein with respect to FIGS. 1-5. In the embodiment of FIGS. 8-10, the head 102 does not have top and bottom abutment members 150C,D, and the top and bottom ends 135, 136 of the post 131 of the damping member 130 are fixed to the inner surfaces 106 on the crown 116 and the sole 118, respectively. In this configuration, the post 131 is vertical or generally vertical and extends across the cavity 107 as similarly described above. The post 131 may be fixed to the inner surfaces 106 of the body 108 using any connection techniques described herein, or other known connection techniques, as described herein. As shown in FIGS. 8-10, the post 131 is connected to the body member 129, but one or both ends 135, 136 of the post 131 may be connected to the face member 128 in another embodiment, depending on the configuration of the head 102 and the position of the damping member 130. The head 102 in FIGS. 8-10 includes front and rear heel and toe abutment members 150A,B with resilient material 140 thereon as described herein with respect to FIGS. 1-5. The damping member in this embodiment has arms 132, 133 that engage the heel and toe abutment members 150A,B, with the arms 132, 133 having weight members 134 thereon, as also described herein with respect to FIGS. 1-5. The abutment members 150 in this embodiment are connected to the body member 129, but one or both abutment members 150 may be connected to the face member 128 in another embodiment, depending on the configuration of the head 102 and the positions of the abutment members 150.

The damping member 130 in the embodiment of FIGS. 8-10 is configured such that the post 131 acts as a "torsion bar" to create a mass damping effect upon impact. In other words, the arms 132, 133 of the damping member 130 can create the mass damping effect by axial twisting of the post 131. The resilient material 140 and the abutment member(s) 150 in this embodiment can also combine with the damping member 130 to create a mass damping effect, particularly during off-center impacts toward the heel 120 or toe 122, as described herein with respect to FIGS. 1-5. The torsional force created by the post 131 and the resiliency and compression of the resilient material 140 permits the damping member 130 to create this mass damping effect, through the connections between the post 131 and the body 108 and the engagement of the arms 132, 133 with the resilient material 140 of the abutment members 150. Additionally, the connection points between the post 131 and the body 108 are aligned laterally with the CG of the face 112 and/or the CG of the head 102 in this embodiment.

The post 131 connected as shown in FIGS. 8-10 and described above is capable of exerting a torsional force on the face 112 upon an impact on the striking face 110. The degree of torsional force of the post 131, and the resultant degree of mass damping of the damping member 130 depends on many factors. For example, the mechanical properties and configuration of the post 131 affect the degree of mass damping, including the dimensions of the post 131, such as thickness, cross-sectional area, or moment of area; material properties, such as shear modulus; rotational stiffness (which incorporates both structural and material properties); etc. As another example, the weight distribution and/or moment of inertia of the damping member 130, particularly relative to the position of the post 131, may also affect the degree of mass damping, e.g., the weight of the weight members 134 and their distances from the post 131. The structure and properties of the damping member 130 can therefore be engineered to provide a desired amount of mass damping upon impacts. It is understood that the resilient material 140 and the properties thereof may also affect the degree of mass damping as well, as described above. Due to the combined effects of the resilient material 140 and the post 131 on the mass damping effect of the damping member 130, a less flexible post 131 may warrant the use of a more flexible resilient material 140, and vice-versa.

The post 131 in the embodiment of FIGS. 8-10 is rotationally fixed to the head 102 at the top and bottom ends 135, 136. As used herein, two components may be considered to be "rotationally fixed" to each other if no significant rotation of one component with respect to the other can be accomplished without deformation (e.g., bending, twisting, flexing, etc.) of one or both components. It is understood that "deformation" may refer to elastic deformation, plastic deformation, fracture, or any other type of deformation. In various embodiments, this rotational fixing can be accomplished by a variety of different structures, including integral forming; a bonding and/or integral joining technique, such as welding, brazing, soldering, adhesive, etc.; a male/female connection using a friction-fit or interference fit; a male/female connection using a non-circular pin and receiver, various interlocking structures, such as a tab-and-slot structure or a gear tooth structure, various fasteners, as well as combinations of these structures and other structures that can accomplish rotational fixing.

In the club head 102 illustrated in FIGS. 8-10, during impact, the momentum of the damping member 130 exerts a torsional force on the post 131, causing the post 131 to exert a torsional force on the face 112 to achieve this mass damping effect. The post 131 exerts the torsional force located at the connection point(s) between the post 131 and the head 102, i.e., at the connection points between the top and bottom ends 135, 136 of the post 131 and the body 108. This torque exerted on the body 108 is exerted on the face 112 through the connection between the body 108 and the face 112. As described above, the actions achieving the mass damping effect occur between the beginning and the end of the impact, which in one embodiment of a golf driver may be between 4-5 ms.

More specifically, on a heel-side impact in the embodiment of FIGS. 8-10, at least some of the mass damping effect of the damping member 130 may be achieved by an initial clockwise (viewed from above) torsional force located at the top and bottom ends 135, 136 of the post 131 during impact. Likewise, on a toe-side impact, at least some of the mass damping effect of the damping member 130 may be achieved by an initial counter-clockwise torsional force located at the top and bottom ends 135, 136 of the post 131 during impact. This initial torsional force has a moment that is opposed to the moment exerted on the head 102 by the impact of the ball on the face 112. The initial torsional force exerted by the post 131 may be as described above, however, the torsional force may cycle repeatedly after impact, i.e., cycling between clockwise and counterclockwise forces. Each cycle will be generally smaller than a previous cycle, if applicable, as a result of hysteresis losses within the post, resulting in the mass damping effect.

Figure 11:
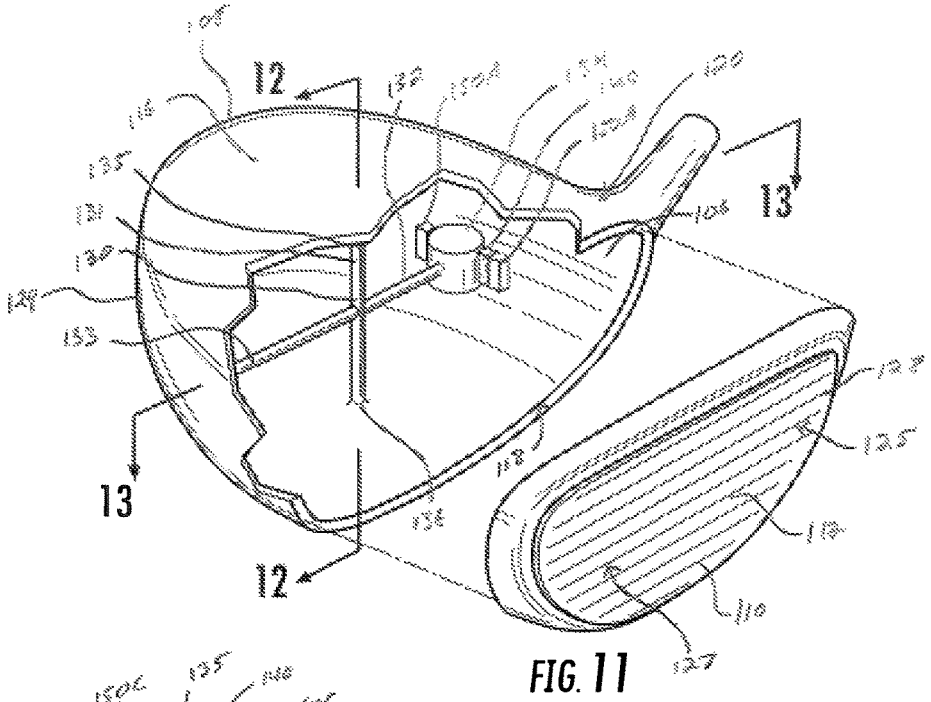
FIG. 11 is a partially exploded and broken away perspective view of another embodiment of a head for a ball striking device according to aspects of the present disclosure, in the form of a golf driver head.
Figure 12:
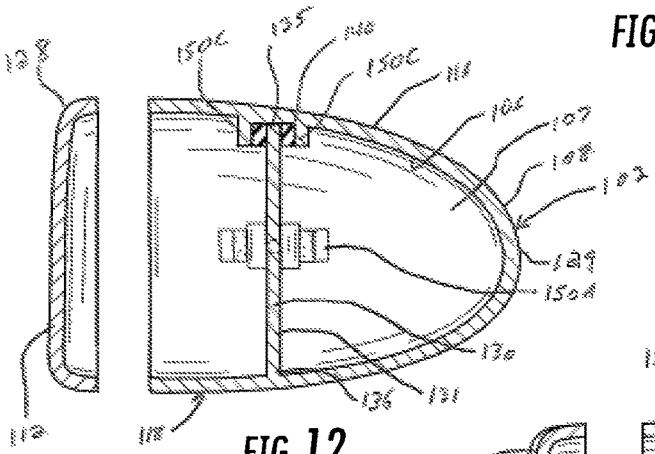
FIG. 12 is a cross-section view taken along lines 12-12 of FIG. 11.
Figure 13:
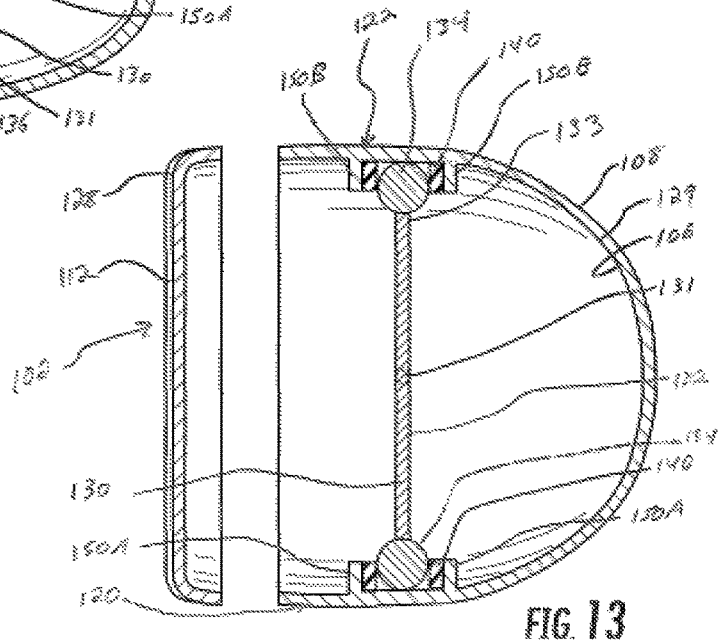
FIG. 13 is a cross-section view taken along lines 13-13 of FIG. 11.

The club head 102 in the embodiment of FIGS. 11-13 is structurally similar to the club heads 102 described above with respect to FIGS. 1-10, and generally may include any of the features (including alternate embodiments) described herein with respect to FIGS. 1-10. In the embodiment of FIGS. 11-13, the head 102 has a damping member 130 with a post 131 that has the bottom end 136 rotationally fixed to the inner surface 106 of the sole 118, as in the embodiment of FIGS. 8-10, with the top end 135 engaging top abutment members 150C as in the embodiment of FIGS. 1-5. In another embodiment, the top end 135 of the post 131 may be rotationally fixed to the inner surface 106 of the crown 116, and the bottom end 136 of the post 131 may engage bottom abutment members 150D as in the embodiment of FIGS. 1-5. In this configuration, the post 131 is vertical or generally vertical and extends across the cavity 107 as similarly described above. The head 102 in FIGS. 11-13 includes front and rear heel and toe abutment members 150A,B with resilient material 140 thereon as described herein with respect to FIGS. 1-5. The damping member 130 in this embodiment has arms 132, 133 that engage the heel and toe abutment members 150A,B, with the arms 132, 133 having weight members 134 thereon, as also described herein with respect to FIGS. 1-5. The post 131 and the abutment members 150 in this embodiment may be connected to the head 102 in any location or configuration described herein.

The damping member 130 in the embodiment of FIGS. 11-13 is configured such that the post 131 acts as a "torsion bar" to create a mass damping effect upon impact, as described herein with respect to FIGS. 8-10. The torque or torsional force generated by twisting of the post 131 is exerted at the connection point between the bottom end 136 of the post 131 and the head 102. The resilient material 140 and the heel and toe abutment members 150A,B in this embodiment can also combine with the damping member 130 to create a mass damping effect during off-center impacts toward the heel 120 or toe 122, as described herein with respect to FIGS. 1-5. Further, the resilient material 140 and the top abutment members 150C can combine with the damping member 130 to create a mass damping effect during high or low impacts, as described herein with respect to FIGS. 1-5.

The club head 102 in the embodiment of FIGS. 14-19 is structurally similar to the club heads 102 described above with respect to FIGS. 1-13, and generally may include any of the features (including alternate embodiments) described herein with respect to FIGS. 1-13. In the embodiment of FIGS. 14-19, the head 102 has an adjustable damping member 130 that includes a rotatable post 131 and a moveable member 137 mounted on the post 131. The moveable member 137 in this embodiment includes a connection member 138 that engages the post 131, and two arms 132, 133 extending outward from the connection member 138 toward the heel 120 and toe 122 of the club head 102. The arms 132, 133 in this embodiment have weight members 134 at or near their ends, as described above with respect to FIGS. 1-5.

The head 102 in FIGS. 14-19 includes front and rear heel and toe abutment members 150A,B with resilient material 140 thereon as described herein with respect to FIGS. 1-5. The abutment members 150A,B in one embodiment are in the form of bracing columns that extend from one or more inner surfaces 106 of the body 108 into the cavity 107. In the embodiment of FIGS. 14-19, the abutment members 150A,B are in the form of bracing columns connected to the inner surfaces 106 of the crown 116 and the sole 118 and extending in a vertical or substantially vertical manner across the cavity 107. The abutment members 150A,B in this embodiment form vertical or substantially vertical tracks 151 in the spaces between the front abutment members 150A,B and the rear abutment members 150A,B. The arms 132, 133 of the damping member 130 engage the heel and toe abutment members 150A,B, as also described herein with respect to FIGS. 1-5, and portions of the arms 132, 133 are received in the tracks 151 and can move along the tracks 151 as the movable member 137 is moved vertically. The weight members 134 are the portions of the arms 132, 133 that engage the abutment members 150A,B and are received in the tracks 151 in the embodiment of FIGS. 14-19, but the damping member 130 may be differently configured in other embodiments, such that other portions of the arms 132, 133 are received in the tracks 151 and/or engage the abutment members 150A,B. The engagement between the arms 132, 133 and the abutment members 150A,B also prevent rotation of the moveable member 137 with respect to the face 112. The connection member 138 and the post 131 are both threaded in a complementary manner.

The resilient material 140 and the heel and toe abutment members 150A,B in this embodiment can combine with the damping member to create a mass damping effect during off-center impacts toward the heel 120 or toe 122, as described herein with respect to FIGS. 1-5. The damping member 130 in this embodiment creates the mass damping effect located at the abutment members 150A,B, i.e., at the connection points between the abutment members 150 and the crown and sole 116, 118.

Figure 14:
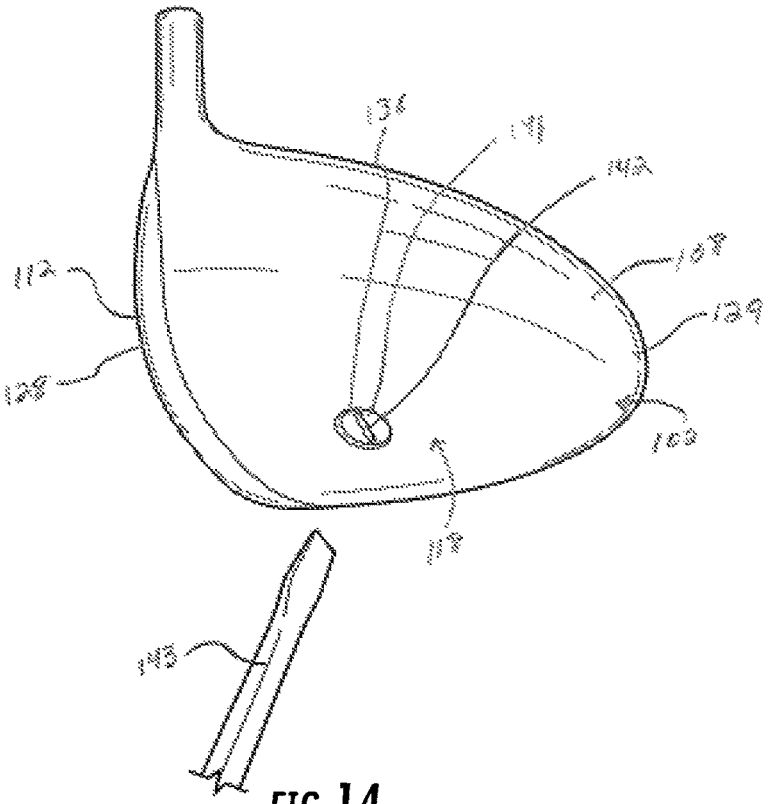
FIG. 14 is a bottom perspective view of another embodiment of a head for a ball striking device according to aspects of the present disclosure, in the form of a golf driver head.
Figure 15:
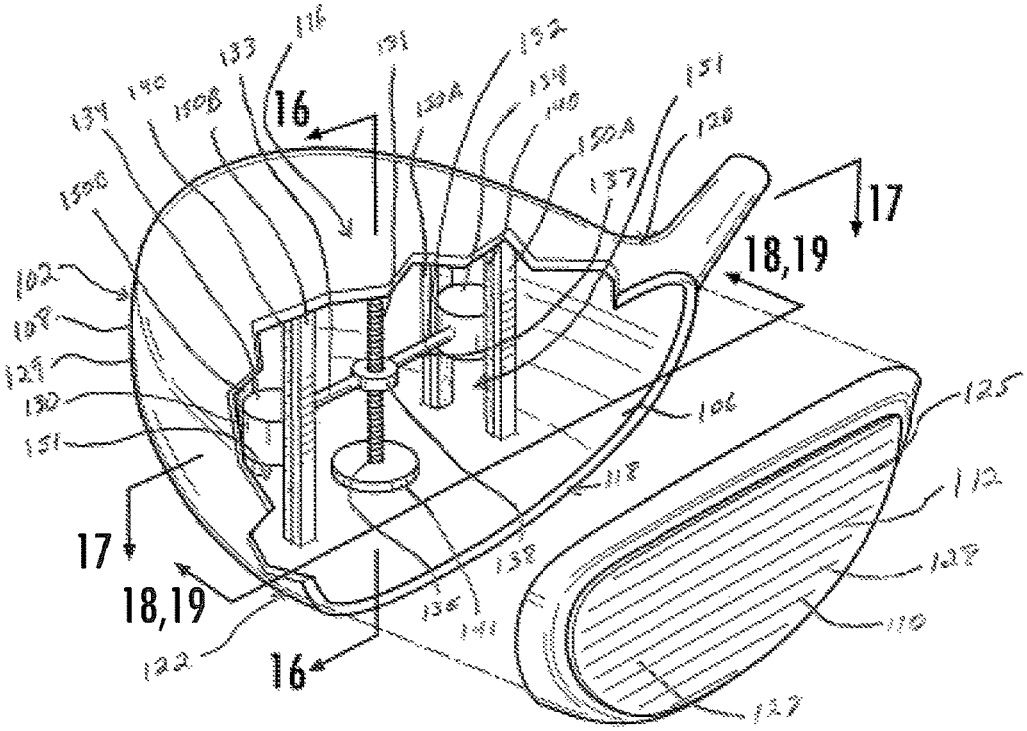
FIG. 15 is a partially exploded and broken away perspective view of the head of FIG. 14.
Figure 16:
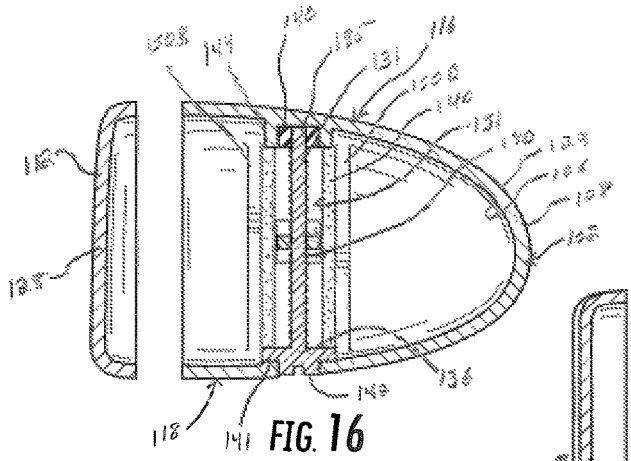
FIG. 16 is a cross-section view taken along lines 16-16 of FIG. 15.
Figure 17:
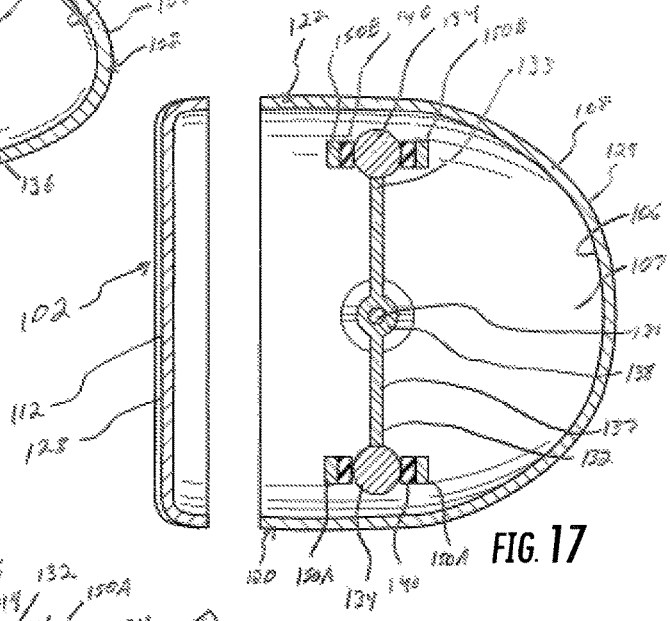
FIG. 17 is a cross-section view taken along lines 17-17 of FIG. 15.

The post 131 in FIGS. 14-19 is rotatably mounted to the head 102, and includes a rotatable base 141 at the bottom end 136 engaging the sole 118 and extending through the wall of the body 108 at the sole 118, with the post 131 extending upward from the base 141 into the internal cavity 107. The base 141 in this embodiment is a plate-like structure that has an engagement structure 142 thereon, which is configured to be engaged by a user to manipulate the post 131, such as shown in FIG. 14, which illustrates an implement in the form of a screwdriver 143 engaging the engagement structure 142. The user may engage the engagement structure 141 with different types of implements, such as sockets, wrenches, Allen wrenches, or other tools; fingers; coins; and other implements capable of rotational locking engagement. The top end 135 of the post 131 is rotatably engaged and supported by a support 144 connected to the inner surface 106 of the crown 116. The support 144 may also have a resilient material 140 engaging the top end 135 of the post 131 in one embodiment, as shown in FIG. 16, in order to function as a front-and-rear pair of abutment members 150C. If the support 144 is configured to function as abutment members 150C, the post 131 may also function to create a mass damping effect on high or low impacts, as described above with respect to FIGS. 1-5. The post 131 and the abutment members 150 in this embodiment may be connected to the head 102 in any location or configuration described herein.

Figure 18:
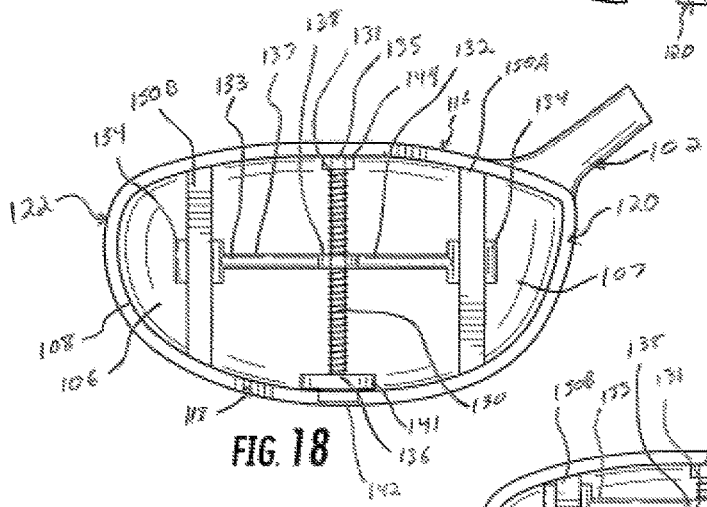
FIG. 18 is a cross-section view taken along lines 18-18 of FIG. 15.
Figure 19:
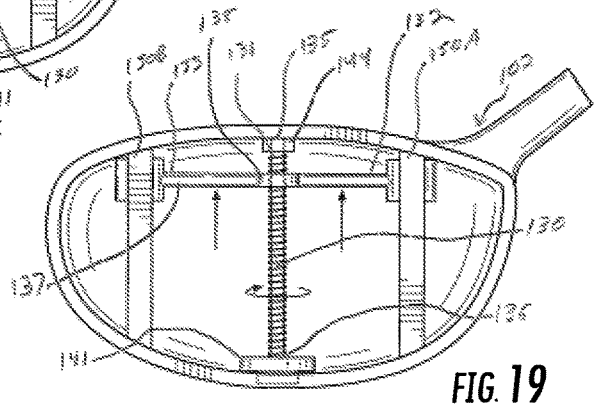
FIG. 19 is a cross-section view taken along lines 18-18 of FIG. 15, illustrating movement of a moveable member within the head.

In the configuration in FIGS. 14-19, rotation of the moveable member 137 is fixed, and rotation of the post 131 by manipulation of the base 141 causes the moveable member 137 to move axially with respect to the post 131 (i.e., upward or downward) due to the threading engagement between the post 131 and the connection member 138, similarly to a jackscrew configuration. As the moveable member 137 is moved upward or downward, the arms 132, 133 slide vertically within the tracks 151 between the abutment members 150A,B. The movement of the moveable member 137 is illustrated in FIGS. 18-19. The structure of the damping member 130 in FIGS. 14-19 enables the CG of the head 102 to be raised and lowered from the exterior of the head 102 by raising and lowering the moveable member 137, while also creating a mass damping effect on off-center impacts. Adjustment of the position of the moveable member 137 may also be used to customize the impact response of the head 102, by changing the degree of mass damping that occurs during impacts at certain areas.

Figure 20:
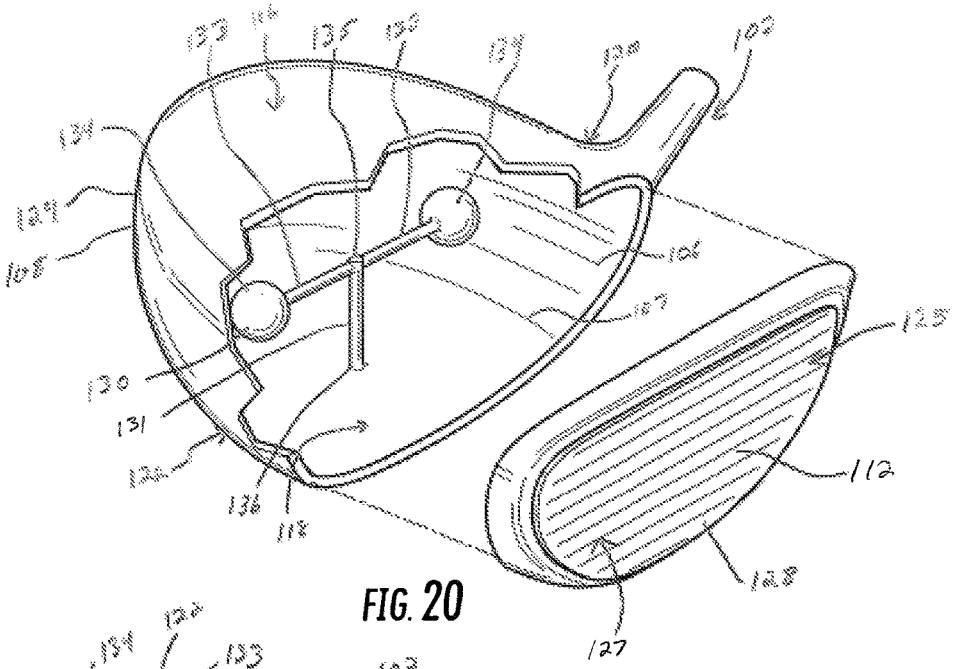
FIG. 20 is a partially exploded and broken away perspective view of another embodiment of a head for a ball striking device according to aspects of the present disclosure, in the form of a golf driver head.
Figure 21:
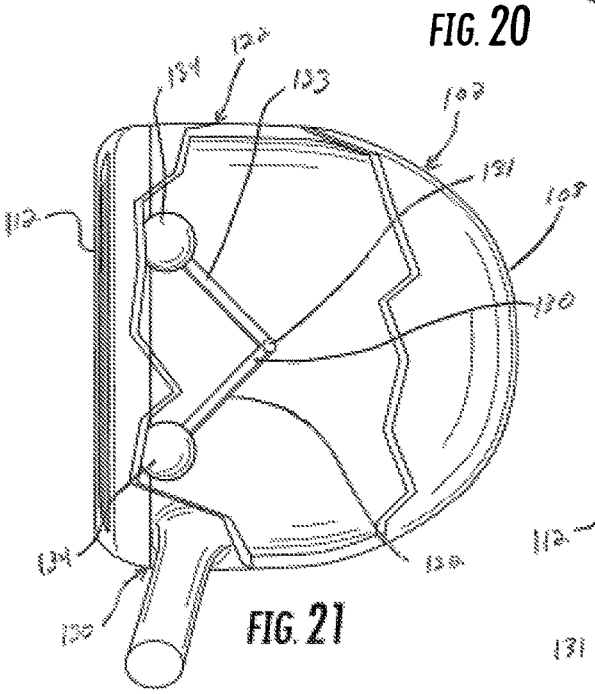
FIG. 21 is a partially exploded and broken away top view of another embodiment of a head for a ball striking device according to aspects of the present disclosure, in the form of a golf driver head.
Figure 22:
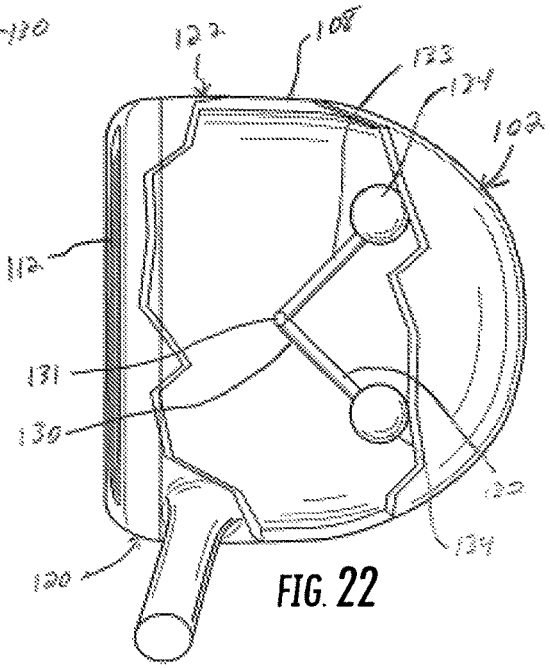
FIG. 22 is a partially exploded and broken away top view of another embodiment of a head for a ball striking device according to aspects of the present disclosure, in the form of a golf driver head.

The club heads 102 in the embodiments of FIGS. 20-22 are structurally similar to the club heads 102 described above with respect to FIGS. 1-19, and generally may include any of the features (including alternate embodiments) described herein with respect to FIGS. 1-19. In the embodiments of FIGS. 20-22, the head 102 has a damping member 130 with a post 131 that has the bottom end 136 rotationally fixed to the inner surface 106 of the sole 118, as in the embodiment of FIGS. 8-10, with the top end 135 being a free end located within the cavity 107. In each of these configurations, the post 131 is vertical or generally vertical and extends across a portion of the cavity 107. In other embodiments, the top end 135 of the post 131 may be rotationally fixed to the inner surface 106 of the crown 116, and the bottom end 136 of the post 131 may be a free end, or the post 131 may extend in a different (non-vertical) direction from another inner surface of the head 102. The damping member 130 in each of these embodiments has arms 132, 133 that extend outwardly from the post 131, with the arms 132, 133 having weight members 134 thereon, as also described herein with respect to FIGS. 1-5. The arms 132, 133 are connected at the top end 135 of the post 131 in this embodiment. The heads 102 in FIGS. 20-22 do not include any abutment members 150 as in the embodiments of FIGS. 1-19, and the ends of the arms 132, 133 are free ends within the cavity 107. The post 131 in these embodiments may be connected to the head 102 in any location or configuration described herein.

The damping member 130 in each of the embodiments of FIGS. 20-22 is configured such that the post 131 acts as a "torsion bar" to create a mass damping effect upon impact, as described herein with respect to FIGS. 8-10. The torsional force generated by twisting of the post 131 is exerted at the connection point between the bottom end 136 of the post 131 and the head 102. The embodiments of FIGS. 20-22 all have the arms 132, 133 positioned at different angles to each other, which may influence the location of the CG of the head 102, as well as the mass damping effect upon impact. For example, FIG. 20 illustrates an embodiment where the arms 132, 133 are positioned at a 180° angle to each other and extend laterally in a direction generally parallel to the face 112. As another example, FIGS. 21 and 22 illustrate embodiments where the arms 132, 133 are positioned at approximately a 90° angle to each other. In FIG. 21, the arms 132, 133 extend outwardly and toward the face 112 at approximately 45° angles to the front-rear direction, and in FIG. 22, the arms 132, 133 extend outwardly and away from the face 112 at approximately 45° angles to the front-rear direction.

The club heads 102 in the embodiments of FIGS. 23-27 are structurally similar to the club heads 102 described above with respect to FIGS. 1-22, and generally may include any of the features (including alternate embodiments) described herein with respect to FIGS. 1-22. In the embodiments of FIGS. 23-27, the head 102 has a damping member 130 with a post 131 that has the bottom end 136 rotationally fixed to the inner surface 106 of the sole 118, as in the embodiment of FIGS. 8-10, with the top end 135 being a free end located within the cavity 107. In each of these configurations, the post 131 is vertical or generally vertical and extends across a portion of the cavity 107. In other embodiments, the top end 135 of the post 131 may be rotationally fixed to the inner surface 106 of the crown 116, and the bottom end 136 of the post 131 may be a free end, or the post 131 may extend in a different (non-vertical) direction from another inner surface of the head 102. The damping member 130 in each of these embodiments has arms 132, 133 that extend outwardly from the post 131, with the arms 132, 133 having weight members 134 thereon, as also described herein with respect to FIGS. 1-5. The heads 102 in FIGS. 23-27 do not include any abutment members 150 as in the embodiments of FIGS. 1-19, and the ends of the arms 132, 133 are free ends within the cavity 107. The post 131 in these embodiments may be connected to the head 102 in any location or configuration described herein.

The damping member 130 in each of the embodiments of FIGS. 23-27 is configured such that the post 131 acts as a "torsion bar" to create a mass damping effect upon impact, as described herein with respect to FIGS. 8-10. The torsional force generated by twisting of the post 131 is exerted at the connection point between the bottom end 136 of the post 131 and the head 102. The embodiments of FIGS. 23-27 also include adjustment mechanisms 145 for adjusting the angles of the arms 132, 133 with respect to each other and with respect to the post 131. The adjustment mechanisms 145 in these embodiments are connected to the free end of the post 131, which is the top end 135 in the embodiments illustrated. Adjustment of the positions of the arms 132, 133 permits adjustment of the CG of the head 102, as well as adjustment of the mass damping effect for impacts on specific areas of the face 112.

Figure 23:
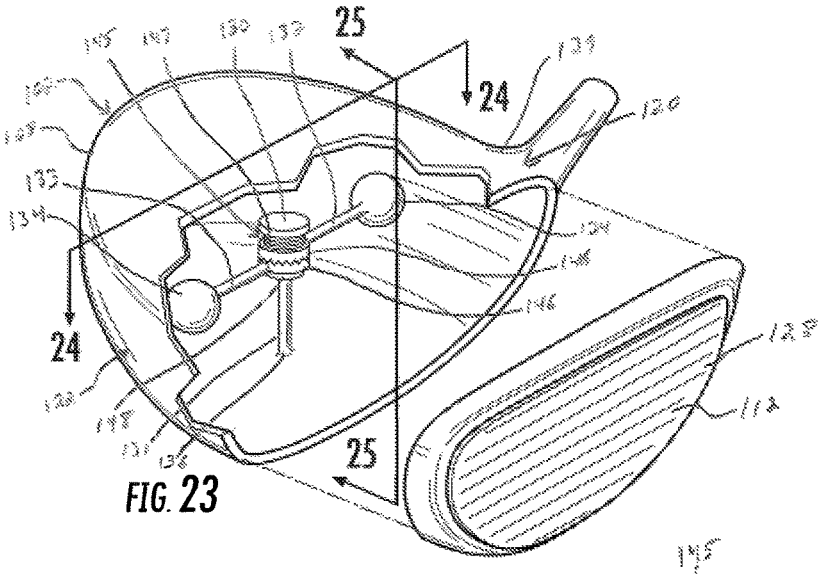
FIG. 23 is a partially exploded and broken away perspective view of another embodiment of a head for a ball striking device according to aspects of the present disclosure, in the form of a golf driver head.
Figure 24:
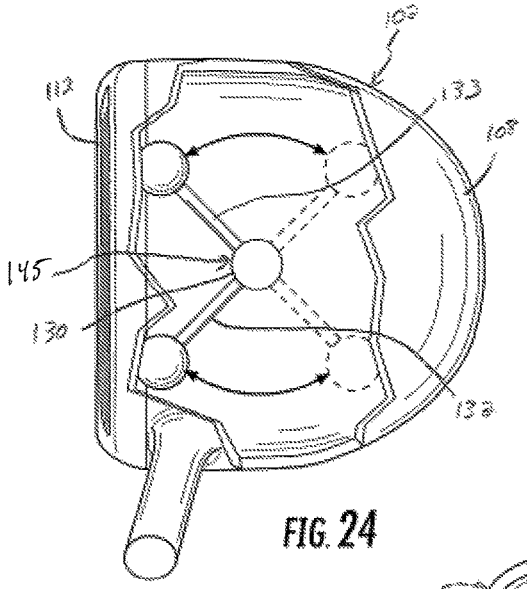
FIG. 24 is a cross-section view taken along lines 24-24 of FIG. 23.
Figure 25:
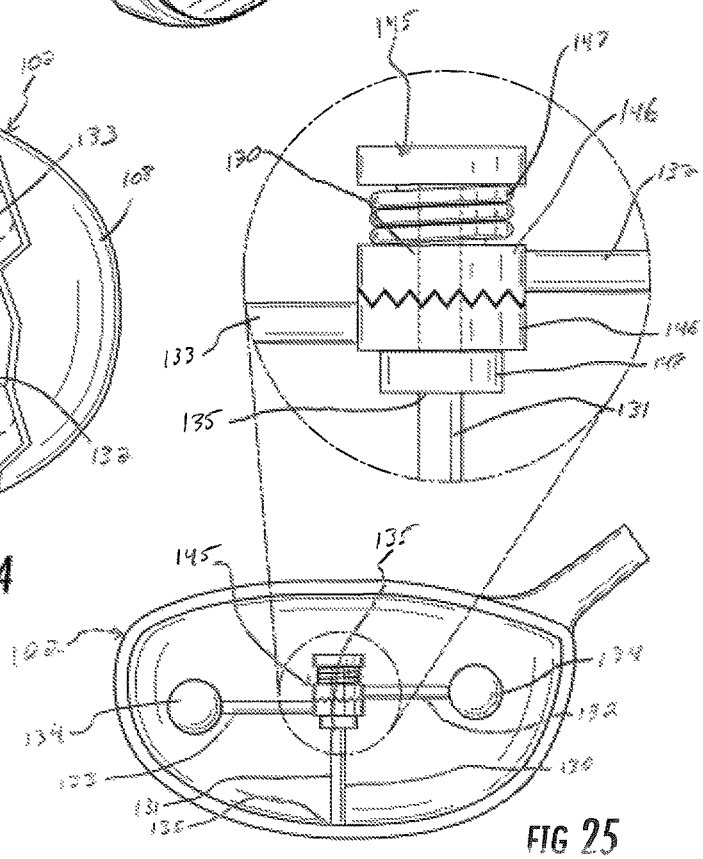
FIG. 25 is a cross-section view taken along lines 25-25 of FIG. 23, with a magnified portion to show detail.

In the embodiment of FIGS. 23-25, the adjustment mechanism 145 includes a locking teeth arrangement to lock the arms 132, 133 in a selected position. In this configuration, each arm 132, 133 has a locking member 146 that is connected to the post 131 by receiving the post 131 through an opening. The locking members 146 of the two arms 132, 133 have locking teeth that face each other and engage each other to lock the arms 132, 133 in position. A spring 147 or other biasing member engages one of the locking members 146 to push the locking members 146 into engagement with each other. The spring 147 may also compress the locking members 146 against a flange 148 on the post 131 to resist rotation of the arms 132, 133 with respect to the post 131, and it is understood that the flange 148 may also include a locking member for rotational locking, such as locking teeth that are complementary with locking teeth on the bottom surface of the second arm 133, in one embodiment. If the locking members 146 are to be adjusted, the spring 147 can be compressed to separate the locking members 146 and permit rotation of the arms 132, 133 with respect to each other and with respect to the post 131, as shown in FIG. 24. Once the arms 132, 133 are in the desired positions, the spring 147 and locking members 146 lock the arms 132, 133 into position once more.

Figure 26:
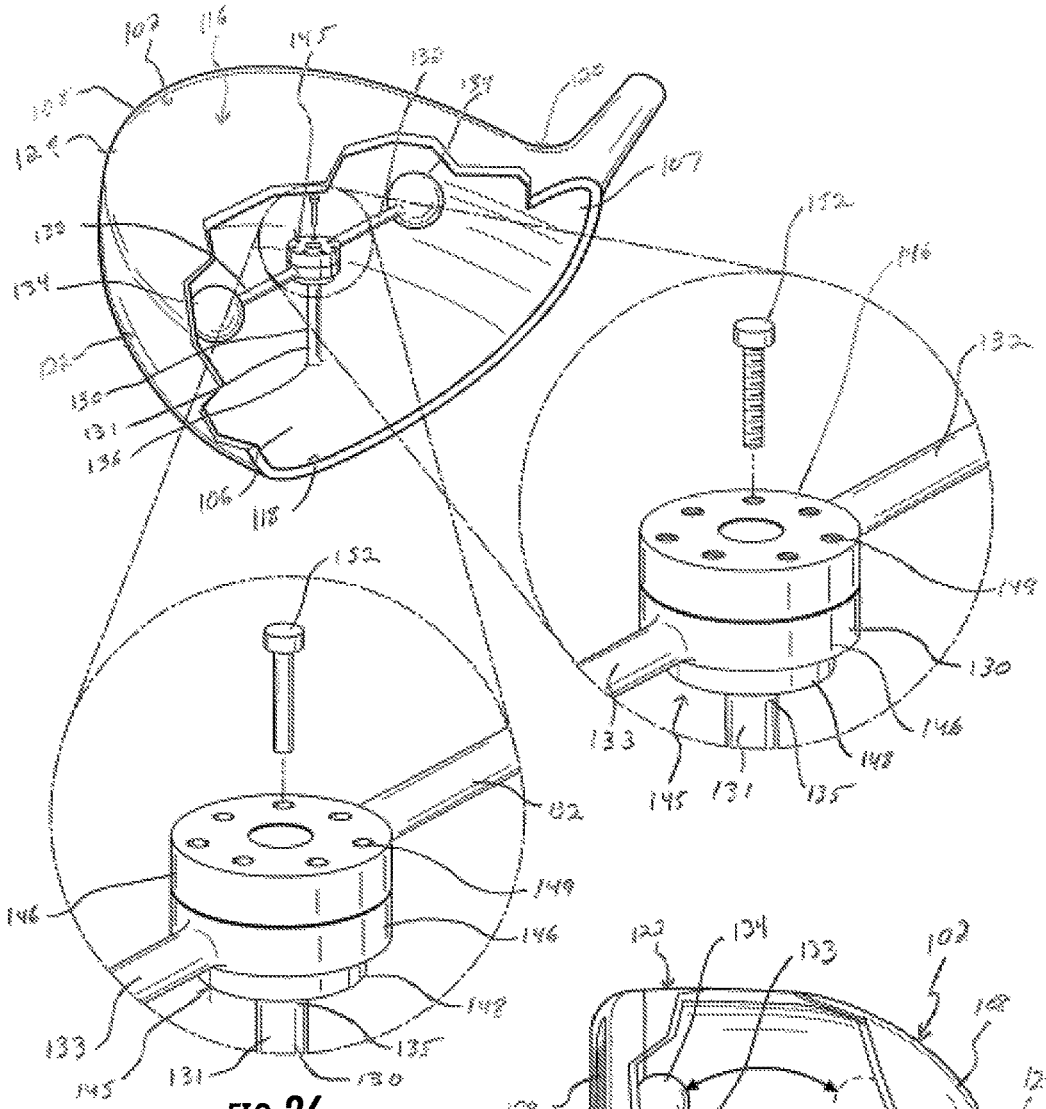
FIG. 26 is a partially exploded and broken away perspective view of another embodiment of a head for a ball striking device according to aspects of the present disclosure, in the form of a golf driver head, with two magnified portions to show detail of two different embodiments of connecting pins.
Figure 27:
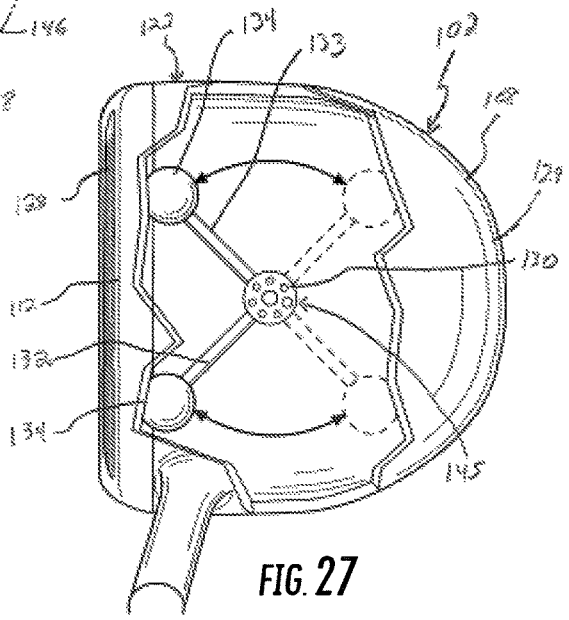
FIG. 27 is a partially exploded and broken away top view of the head of FIG. 26, illustrating movement of two arms within an internal cavity of the head.

In the embodiment of FIGS. 26-27, the adjustment mechanism 145 includes a locking pin arrangement to lock the arms 132, 133 in place in a selected position. In this configuration, each arm 132, 133 has a locking member 146 that is connected to the post 131 by receiving the post 131 through an opening. The locking members 146 of the two arms 132, 133 have a plurality of holes 149 therethrough, and a pin 152 can be received through a hole 149 in each locking member 146 to lock the arms 132, 133 in position. The locking members 146 also rest on flange 148 on the post 131, and it is understood that the flange 148 may also include holes (not shown), such that the pin 152 is received through the holes 149 in the locking members 146 and through a hole in the flange 148, to lock the arms 132 in position with respect to the post 131. As shown in FIG. 26, the pin 152 may be a straight pin, a threaded pin, or a different type of pin with a different type of locking structure (e.g., a cotter pin or a quarter-turn locking structure). If the locking members 146 are to be adjusted, the pin 152 can be removed to release the locking members 146 and permit rotation of the arms 132, 133 with respect to each other and with respect to the post 131, as shown in FIG. 27. Once the arms 132, 133 are in the desired positions, the pin 152 can be reinserted to lock the arms 132, 133 into position once more.

Figure 28:
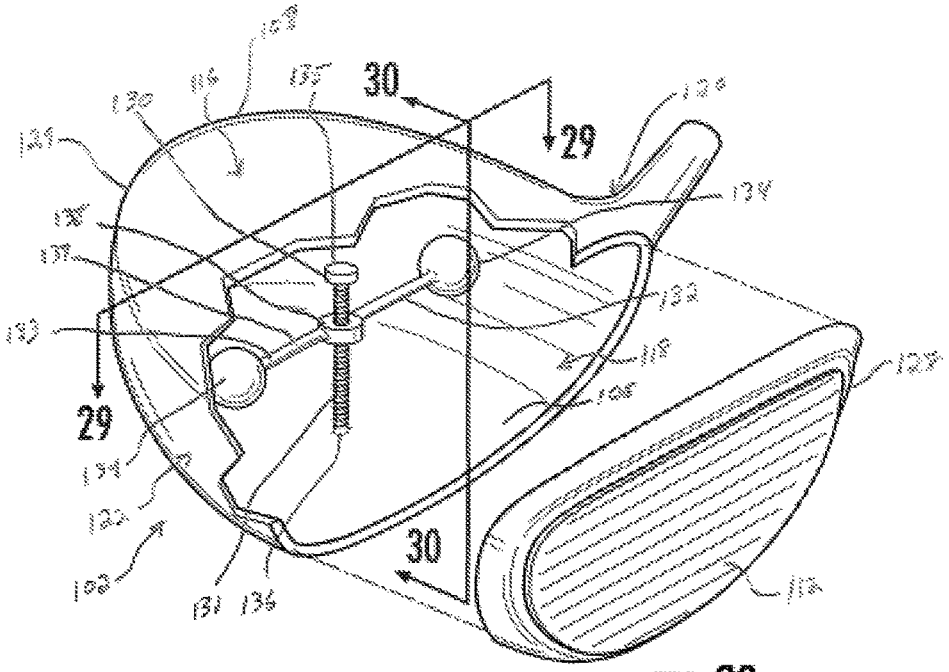
FIG. 28 is a partially exploded and broken away perspective view of another embodiment of a head for a ball striking device according to aspects of the present disclosure, in the form of a golf driver head.
Figure 29:
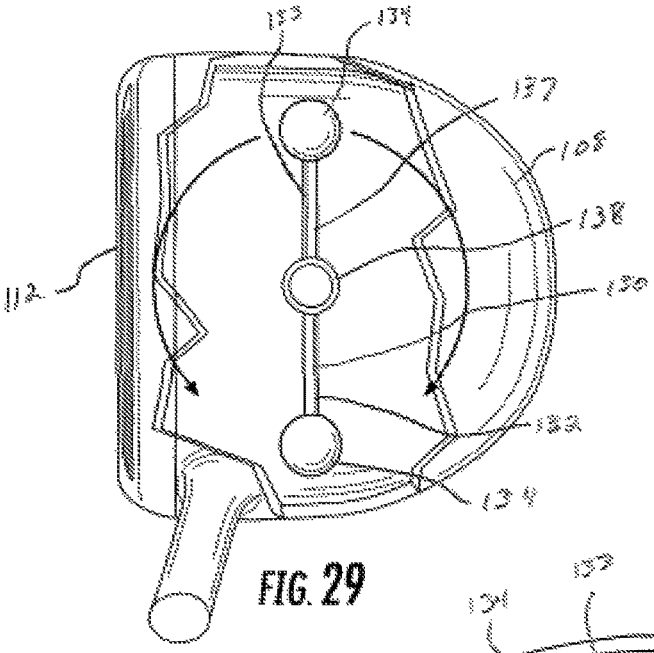
FIG. 29 is a cross-section view taken along lines 29-29 of FIG. 28, illustrating movement of a moveable member within the head.
Figure 30:
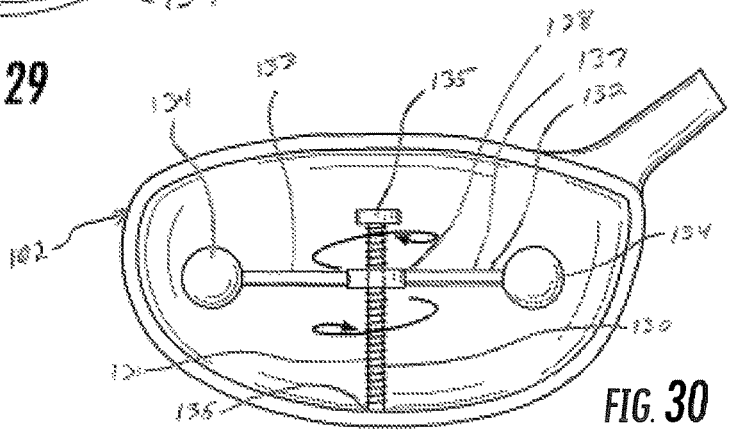
FIG. 30 is a cross-section view taken along lines 30-30 of FIG. 28, illustrating movement of a moveable member within the head.

The club head 102 in the embodiment of FIGS. 28-30 is structurally similar to the club heads 102 described above with respect to FIGS. 1-27, and generally may include any of the features (including alternate embodiments) described herein with respect to FIGS. 1-27. In the embodiment of FIGS. 28-30, the head 102 has an adjustable damping member 130 that includes a fixed post 131 and a moveable member 137 mounted on the post 131. The bottom end 136 of the post 131 is rotationally fixed to the inner surface 106 of the sole 118, and the top end 135 is a free end within the cavity 107. In this configuration, the post 131 is vertical or generally vertical and extends across a portion of the cavity 107. In other embodiments, the top end 135 of the post 131 may be rotationally fixed to the inner surface 106 of the crown 116, and the bottom end 136 of the post 131 may be a free end, or the post 131 may be connected to both the crown 116 and the sole 118, or the post 131 may extend in a different (non-vertical) direction from one or more other inner surfaces of the head 102.

The moveable member 137 in this embodiment includes a connection member 138 that engages the post, and two arms 132, 133 extending outward from the connection member 138 toward the heel 120 and toe 122 of the club head 102. The arms 132, 133 in this embodiment have weight members 134 at or near their ends, as described above with respect to FIGS. 1-5. The connection member 138 and the post 131 have complementary threading, such that the moveable member 137 can be raised, lowered, and angularly adjusted with respect to the post 131 by rotating the moveable member 137 about the post 131, as shown in FIGS. 29-30. Adjustment of the positions of the arms 132, 133 permits adjustment of the CG of the head 102, as well as adjustment of the mass damping effect for impacts on specific areas of the face 112. The damping member 130 may further include some structure for holding or locking the moveable member 137 in position with respect to the post 131, such as a locking structure, or a high-friction threading engagement that is only adjustable through large amounts of torque.

The club heads 102 in the embodiments of FIGS. 31-33 are structurally similar to the club heads 102 described above with respect to FIGS. 1-30, and generally may include any of the features (including alternate embodiments) described herein with respect to FIGS. 1-30. In the embodiment of FIGS. 31-32, the head 102 has a damping member 130 with a post 131 that has the bottom end 136 rotationally fixed to the inner surface 106 of the sole 118, as in the embodiment of FIGS. 8-10, with the top end 135 being a free end within the cavity 107. The top end 135 of the post 131 extends upwardly above the connection between the post 131 and the arms 132, 133. In the embodiment of FIG. 33, the head 102 has a damping member 130 with a post 131 that has the top end 135 rotationally fixed to the inner surface 106 of the crown, as in the embodiment of FIGS. 8-10, with the bottom end 136 being a free end within the cavity 107. The bottom end 136 of the post 131 extends downwardly below the connection between the post 131 and the arms 132, 133. In these configurations, the post 131 is vertical or generally vertical and extends across the cavity 107 as similarly described above. The damping member 130 in each of these embodiments has arms 132, 133 that extend outwardly from the post 131 toward the heel 120 and the toe 122, with the arms 132, 133 having weight members 134 thereon, as also described herein with respect to FIGS. 1-5. The damping member 130 further has a weight member 134 on the free end of the post 131 in these embodiments, i.e., the top end 135 of the post 131 in the embodiment of FIGS. 31-32 and the bottom end 136 of the post 131 in the embodiment of FIG. 33. The posts 131 these embodiments may be connected to the head 102 in any location or configuration described herein.

The damping member 130 in each of the embodiments of FIGS. 31-33 is configured such that the post 131 acts as a "torsion bar" to create a mass damping effect upon impact, as described herein with respect to FIGS. 8-10. The torque or torsional force generated by twisting of the post 131 is exerted at the connection point between the bottom end 136 of the post 131 and the head 102. Further, the weight member 134 on the free end of the post 131 can serve to create a mass damping effect during high or low impacts, as described herein with respect to FIGS. 1-5.

Figure 34:
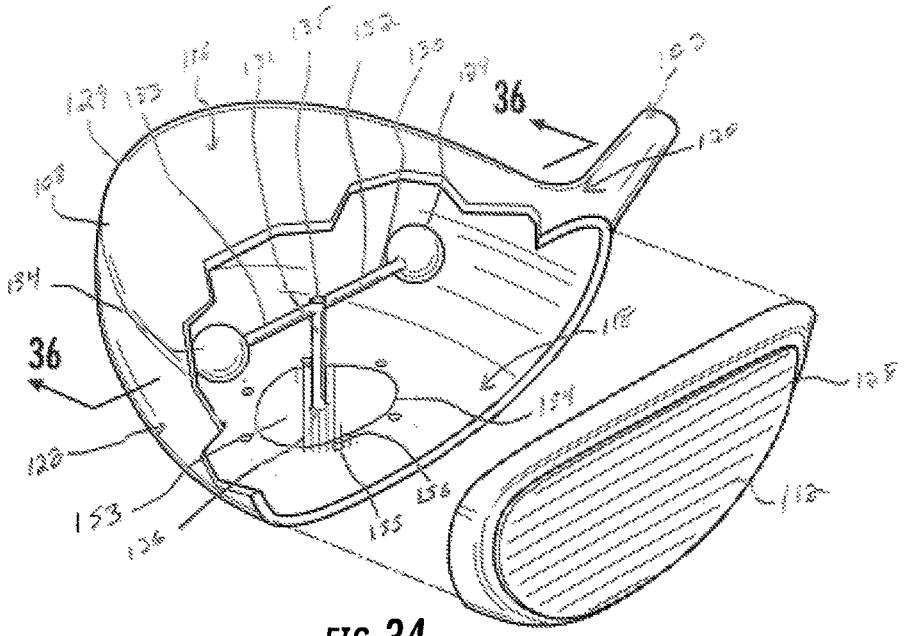
FIG. 34 is a partially exploded and broken away perspective view of another embodiment of a head for a ball striking device according to aspects of the present disclosure, in the form of a golf driver head.
Figure 35:
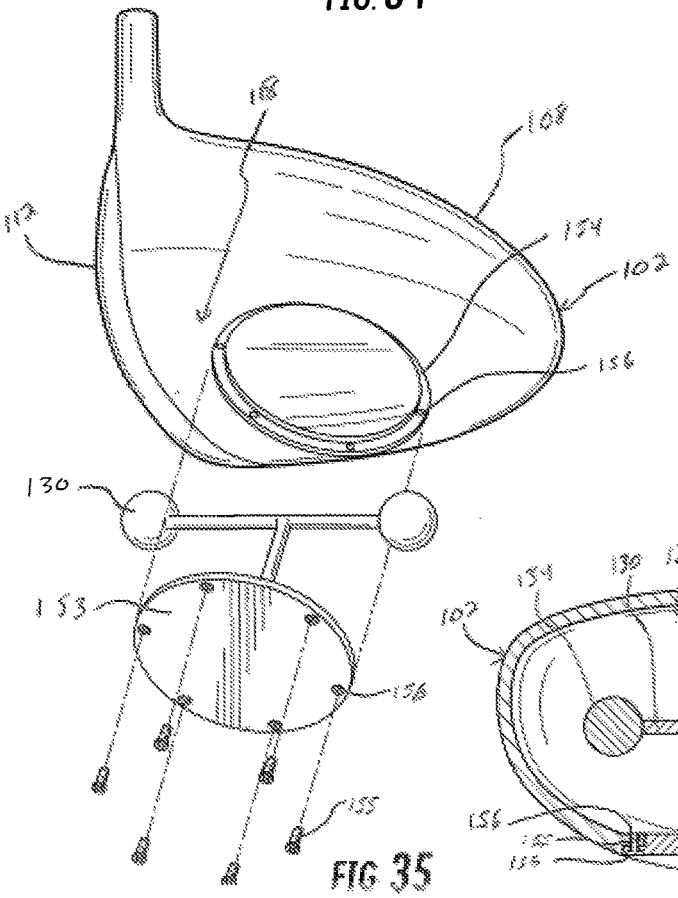
FIG. 35 is an exploded bottom perspective view of the head of FIG. 34.
Figure 36:
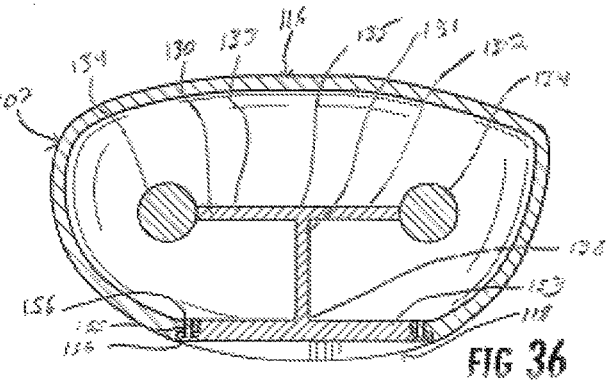
FIG. 36 is a cross-section view taken along lines 36-36 of FIG. 34.

The club head 102 in the embodiment of FIGS. 34-36 includes a damping member 130 that is similar or identical to the damping member 130 in FIG. 20, and has a structure and function that are similar or identical to the damping member 130 in FIG. 20, including any variations or alternate embodiments. The head 102 in FIGS. 34-36 also includes a removable body panel 153 forming a portion of the body 108, where the damping member 130 is mounted to the removable panel 153. In the embodiment in FIGS. 34-36, the damping member 130 is fixedly connected to the removable panel 153, such that the removable panel 153 and the damping member 130 can be removed and interchanged with a different damping member 130 connected to a different removable panel 153. In another embodiment, the damping member 130 may be removably connected to the removable panel 153, permitting the damping member 130 to be interchanged by disconnecting the damping member 130 from the removable panel 153 and connecting a different damping member 130. Further, the removable panel 153 may be used in connection with an adjustable damping member 130, as described below with respect to FIGS. 37-38.

The removable panel 153 in the embodiment of FIGS. 34-36 forms a portion of the sole 118, although in other embodiments, the head 102 may include one or more removable panels 153 that may be located in other locations and form portions of different areas of the body 108. As shown in FIGS. 34-36, the body 108 has an opening 154 in the sole 118, and the removable panel 153 is received in the opening 154 and covers the opening 154. The removable panel 153 is removably connected to the body 108 by a plurality of removable fasteners 155 (e.g., screws, bolts, etc.) that are received through holes 156 in the removable panel 153 and in corresponding holes 156 in the body 108 around the opening 154. In other embodiments, the removable panel 153 may be connected to the body 108 by a different removable connecting structure. As illustrated in FIG. 35, the club head 102 has a face member 128 and a body member 129, and the opening 154 is formed entirely within the body member 129, such that the removable panel 153 is connected to the body member 129. In an embodiment where the body member 129 is made from a polymer-based material, the body member 129 may have a reinforcing structure around the opening 154. In other embodiments, the removable panel 153 may be connected at least partially to the face member 128, depending on the configurations of the face and body members 128, 129 and the configuration and location of the removable panel 153. It is understood that in other embodiments, the head 102 may not have separately identifiable face and body members 128, 129.

Figure 37:
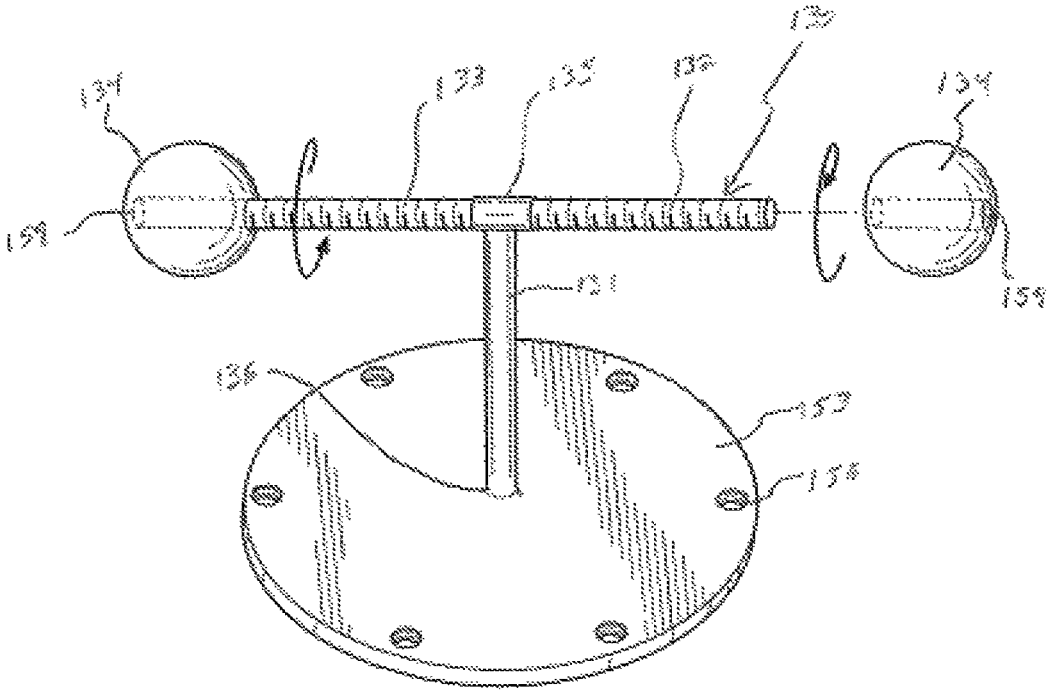
FIG. 37 is a front view of one embodiment of an adjustable damping member and a removable body panel configured for use with a head for a ball striking device according to aspects of the present disclosure.
Figure 38:
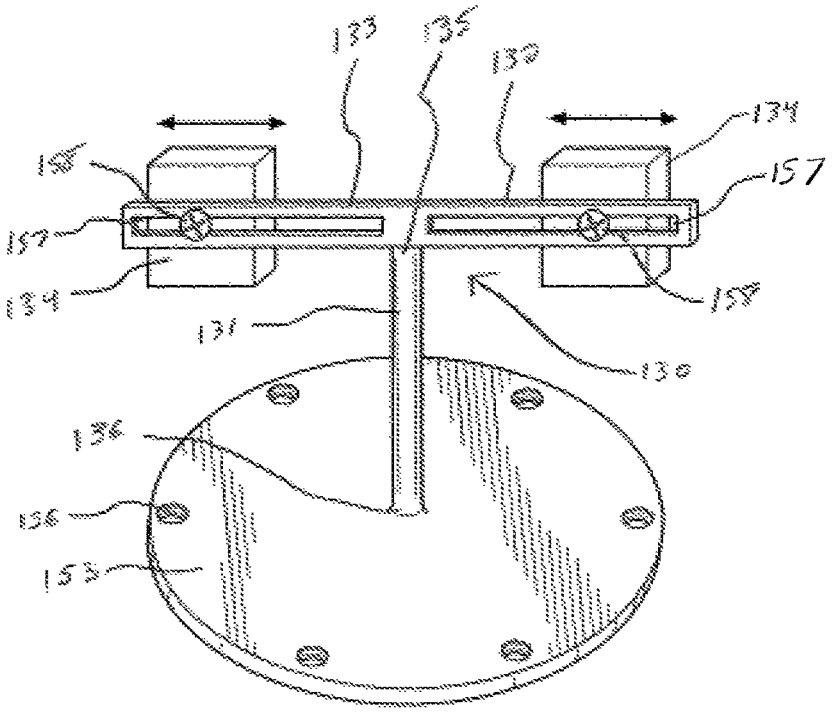
FIG. 38 is a front view of another embodiment of an adjustable damping member and a removable body panel configured for use with a head for a ball striking device according to aspects of the present disclosure.

FIGS. 37-38 illustrate embodiments of adjustable damping members 130 connected to removable body panels 153 as described herein with respect to FIGS. 34-36, which may be used with a club head as shown in FIGS. 34-36 or other embodiments described herein. In the embodiment of FIG. 37, the damping member 130 includes a post 131 with the bottom end 136 connected to the removable body panel 153 and threaded arms 132, 133 extending outwardly from the top end 135 of the post 131 toward the heel 120 and toe 122. The arms 132, 133 have adjustable weight members 134 connected thereto, with the weight members 134 having threaded holes 159 to receive the arms 132, 133 therethrough. The positions of the weight members 134 on the arms 132, 133 can be adjusted by rotating the weight members 134 on the threaded arms 132, 133 to achieve translational motion. The weight members 134 can also be removed and interchanged by this action as well. In the embodiment of FIG. 38, the damping member 130 includes a post 131 with the bottom end 136 connected to the removable body panel 153 and arms 132, 133 extending outwardly from the top end 135 of the post 131 toward the heel 120 and toe 122. The arms 132, 133 have tracks 157 formed by elongated openings through the arms 132, 133, and adjustable weight members 134 are connected to the arms 132, 133, with the weight members 134 having fasteners 158 that are received in the tracks 157 to connect the weight members 134 to the arms 132, 133. The positions of the weight members 134 on the arms 132, 133 can be adjusted by loosening the fasteners 158 and sliding the weight members 134 along the tracks 157, then tightening the fasteners 158 in the desired positions. The weight members 134 can also be removed and interchanged as well, by removing the fasteners 158 and reconnecting them to a different weight member 134.

The damping members 130 in FIGS. 37-38 or other adjustable damping members 130 may be located, structured, and oriented differently, as described elsewhere herein. The damping members 130 in FIGS. 37-38 may be fixedly or removably connected to the removable panel 153, as described above with respect to FIGS. 34-36. It is understood that other adjustable damping members 130, including any of the other internally adjustable mechanisms disclosed herein, such as the embodiments in FIGS. 23-30, may include a configuration with a removable body panel 153 as illustrated in FIGS. 34-38, or a different structure for providing access to the cavity 107, such as a removable face 112 as discussed elsewhere herein, or a different removable portion of the head 102. The adjustable damping member 130 may be directly connected to the removable panel 153 or connected elsewhere within the cavity 107. The removable panel 153 may be removed to provide access to the damping member 130 for adjustment thereof. Such damping members 130 may be fixedly or removably connected to the removable panel 153, as described above with respect to FIGS. 34-36.

It is understood that any of the embodiments of ball striking devices 100, heads 102, damping members 130, and other components described herein may include any of the features described herein with respect to other embodiments described herein, including structural features, functional features, and/or properties, unless otherwise noted. It is understood that the specific sizes, shapes, orientations, and locations of various components of the ball striking devices 100 and heads 102 described herein are simply examples, and that any of these features or properties may be altered in other embodiments. In particular, any of the damping members 130 or structures shown and described herein may be used in connection with any other embodiment shown herein. For example, various configurations of adjustable mechanisms for the damping members 130 may be used simultaneously in some embodiments.

Heads 102 incorporating the features disclosed herein may be used as a ball striking device or a part thereof. For example, a golf club 100 as shown in FIG. 2 may be manufactured by attaching a shaft or handle 104 to a head that is provided, such as the head 102 as described above. As another example, a golf club 100 as shown in FIG. 2 may be manufactured by attaching damping member 130 to club head 102 or body member 129 that is provided, and connecting a face member 128 to the body member 129. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. In one embodiment, a set of golf clubs can be manufactured, where at least one of the clubs has a head according to one or more embodiments described herein. Such a set may include at least one wood-type club, at least one iron-type club, and/or at least one putter. For example, a set may include one or more wood-type golf clubs and one or more iron-type golf clubs, which may have different loft angles, as well as one or more putters, with one or more clubs having a head 102 as described above and shown in FIGS. 1-38. Multiple clubs in the set may have damping members 130 that may be slightly different in shape, size, location, orientation, etc., based on the loft angle of the club. The various clubs may also have an added weight amount or weight distribution (including CG location) that may be different based on characteristics such as the type and loft angle of the club.

Different damping members 130 and different locations, orientations, and connections thereof, may produce different mass damping effects upon impacts on the striking surface 110, including off-center impacts. Additionally, different damping members 130 and different locations, orientations, and connections thereof, may produce different effects depending on the location of the ball impact on the face 112. Accordingly, one or more clubs can be customized for a particular user by providing a club with a head as described above, with a damping member 130 that is configured in at least one of its shape, size, location, orientation, etc., based on a hitting characteristic of the user, such as a typical hitting pattern or swing speed. Customization may also include adding or adjusting weighting according to the characteristics of the damping member 130 and the hitting characteristic(s) of the user. Several different adjustable and/or interchangeable damping members 130 as described herein can permit such customization by an end user and/or a golf shop. Still further embodiments and variations are possible, including further techniques for customization.

The ball striking devices described herein may be used by a user to strike a ball or other object, such as by swinging or otherwise moving the head 102 to strike the ball on the striking surface 110 of the face 112. During the striking action, the face 112 impacts the ball, and one or more damping members 130 may create a mass damping effect during the impact, in any manner described above. In one embodiment, the damping member(s) 130 may create an incrementally greater mass damping effect for impacts that are farther from the desired impact point (e.g. the CG). As described below, the devices described herein, when used in this or a comparable method, may assist the user in achieving more consistent accuracy and distance of ball travel, as compared to other ball striking devices.

The various embodiments of ball striking heads with damping members described herein can provide mass damping effects upon impacts on the striking face, which can assist in keeping the striking face more square with the ball, particularly on off-center impacts, which can in turn provide more accurate ball direction. Additionally, the mass damping effect of the damping member can reduce or minimize energy loss on off-center impacts, creating more consistent ball speed and distance. The mass damping effect may be incremental based on the distance of the impact away from the desired or optimal impact point. Further, the resilient material may achieve some energy absorption or damping on center impacts (e.g. aligned with the center point and/or the CG of the face). As a result of the reduced energy loss on off-center hits, reduced twisting of the face on off-center hits, and/or energy absorption on center hits that can be achieved by the heads as described above, greater consistency in both lateral dispersion and distance dispersion can be achieved as compared to typical ball striking heads of the same type, with impacts at various locations on the face. The ball striking heads described herein can also provide dissipation of impact energy through the resilient material, which can reduce vibration of the club head and may improve feel for the user. Still further, the connection members can be used to control the weighting of the club head and/or the damping member. Other benefits can be recognized and appreciated by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A ball striking device comprising:

a face having a striking surface configured for striking a ball, the face having a heel portion and a toe portion; a body connected to the face and extending rearwardly from the face, the body having a crown, a sole, a heel side, and a toe side, wherein the face and the body combine to define an enclosed internal cavity; and wherein the body has an opening in the sole, wherein a removable panel is received in the opening, wherein the removable panel is removably connected to the body by a plurality of removable fasteners, a damping member connected to the removable panel, wherein when the removable panel is connected to the body, the damping member comprising a single post extends inwardly into the enclosed internal cavity from the removable panel, wherein the single post has a first fixed end that is attached to the removable panel, a first arm extending from the single post toward the heel side of the body, and a second arm extending from the single post toward the toe side of the body, wherein the damping member is configured to produce a mass damping effect upon an impact on the face, wherein the first arm further comprises a first weight member connected to the first arm and the second arm further comprises a second weight member connected to the second arm, wherein the first and second weight members have greater densities than the single post.

2. The ball striking device of claim 1, further comprising:

a first abutment member connected to the inner surface of the body and positioned within the enclosed internal cavity adjacent the first arm, the first abutment member comprising a resilient material engaging a front surface of the first arm; and a second abutment member connected to the inner surface of the body and positioned within the enclosed internal cavity adjacent the second arm, the second abutment member comprising a resilient material engaging a front surface of the second arm, wherein the resilient material of the first abutment member is configured to be compressed by the first arm during the impact on the heel portion of the face, and the resilient material of the second abutment member is configured to be compressed by the second arm during the impact on the toe portion of the face, creating the mass damping effect.

3. The ball striking device of claim 2, wherein the first abutment member further has the resilient material engaging a rear surface of the first arm, and the second abutment member further has the resilient material engaging a rear surface of the second arm, and wherein the resilient material of the first abutment member is configured to be compressed by the first arm during the impact on the toe portion of the face, and the resilient material of the second abutment member is configured to be compressed by the second arm during the impact on the heel portion of the face, to further provide the mass damping effect.

4. The ball striking device of claim 1, wherein the single post has a fixed end that is fixed to the removable panel, and a free end positioned within the enclosed internal cavity when the removable panel is removably attached to the body.

5. The ball striking device of claim 4, further comprising a third abutment member connected to the inner surface of the body opposite the fixed end of the single post and positioned within the enclosed internal cavity, the third abutment member comprising a resilient material engaging the free end of the single post, wherein the resilient material of the third abutment member is configured to be compressed by the free end of the single post during the impact on the face, to create the mass damping effect.

6. The ball striking device of claim 1, wherein the single post is threaded and the first and second arms are threadably engaged with the single post, such that the first and second arms are movable axially along the single post by relative rotation between the single post and the first and second arms.

7. The ball striking device of claim 6, wherein the single post is supported by the removable panel to be freely rotatable and the first and second arms are rotationally fixed, such that rotation of the single post is configured to cause axial movement of the first and second arms with respect to the single post.

8. The ball striking device of claim 6, wherein the first and second arms are freely rotatable with respect to the single post, and the single post is rotationally fixed, such that rotation of the first and second arms with respect to the single post is configured to cause axial movement of the first and second arms with respect to the single post.

9. The ball striking device of claim 1, wherein the first and second arms are oriented at approximately 180° to each other.

10. The ball striking device of claim 1, wherein the first and second arms are configured such that an angle defined between the first and second arms is adjustable.

11. A golf club comprising the ball striking device of claim 1, wherein the ball striking device is a golf club head, and a shaft connected to the ball striking device.

12. A golf club comprising the ball striking device of claim 1, wherein the first and second weight members are spherical.

13. A golf club comprising the ball striking device of claim 1, wherein the first and second weight members are cylindrical.

14. A golf club comprising the ball striking device of claim 1, wherein the first weight member has a threaded hole to receive the first arm, and wherein the second weight member has a threaded hole to receive the second arm, wherein the first and second arms are threaded.

15. A golf club comprising the ball striking device of claim 14, wherein the positions of the first and second weight members can be adjusted on the first and second arms to achieve translational motion.

16. A golf club comprising the ball striking device of claim 1, wherein the first and second weight members can be removed and interchanged with other weight members.

17. A golf club comprising the ball striking device of claim 1, wherein the first and second arms have tracks along their length, and wherein the first and second weight members are attached to fasteners received in the tracks of the first and second arms.

18. A golf club comprising the ball striking device of claim 17, wherein the first and second weight members can be moved along the length of first and second arms by loosening and retightening the fasteners received in the tracks of the first and second arms.

19. A golf club comprising the ball striking device of claim 1, wherein the single post is detachably attached from the removable panel such that different dampening members may be attached to the removable panel.

20. A ball striking device comprising:

a face having a striking surface configured for striking a ball, the face having a heel portion and a toe portion;

a body connected to the face and extending rearwardly from the face, the body having a crown, a sole, a heel side, and a toe side, wherein the face and the body combine to define an enclosed internal cavity; and wherein the body has an opening in the sole, wherein a removable panel is received in the opening, wherein the removable panel is removably connected to the body by a plurality of removable fasteners, a damping member connected to the removable panel, wherein when the removable panel is connected to the body, the damping member comprising a single post extends inwardly into the enclosed internal cavity from an inner surface of the body, wherein the single post has a first fixed end that is attached to the removable panel, a first arm extending along a first direction from the single post toward the heel side of the body, and a second arm extending along a second direction opposite to the first direction from the single post toward the toe side of the body, wherein the damping member is configured to produce a mass damping effect upon an impact on the face, wherein the first arm further comprises a first weight member connected to the first arm and the second arm further comprises a second weight member connected to the second arm, wherein the first weight member has an enlarged peripheral dimension perpendicular to the first direction compared to the first arm, and wherein the second weight member has an enlarged peripheral dimension perpendicular to the second direction compared to the second arm.

* * * * *